US008561584B2

(12) United States Patent
Wigsten

(10) Patent No.: US 8,561,584 B2
(45) Date of Patent: Oct. 22, 2013

(54) CAM PHASER CENTRALLY LOCATED ALONG CONCENTRIC CAMSHAFTS

(75) Inventor: Mark Wigsten, Lansing, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 13/637,071

(22) PCT Filed: Mar. 29, 2011

(86) PCT No.: PCT/US2011/030250
§ 371 (c)(1),
(2), (4) Date: Sep. 25, 2012

(87) PCT Pub. No.: WO2011/126815
PCT Pub. Date: Oct. 13, 2011

(65) Prior Publication Data

US 2013/0025403 A1 Jan. 31, 2013

Related U.S. Application Data

(60) Provisional application No. 61/321,202, filed on Apr. 6, 2010.

(51) Int. Cl.
*F01L 1/34* (2006.01)

(52) U.S. Cl.
USPC ..... 123/90.17; 123/90.15; 123/90.31

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 5,107,804 | A | 4/1992 | Becker et al. | |
| 5,172,659 | A | 12/1992 | Butterfield et al. | |
| 5,664,463 | A | 9/1997 | Amborn et al. | |
| 6,176,210 | B1 | 1/2001 | Lichti et al. | |
| 6,745,732 | B2 | 6/2004 | Ekdahl et al. | |
| 6,763,791 | B2 | 7/2004 | Gardner et al. | |
| 6,883,481 | B2 | 4/2005 | Gardner et al. | |
| 7,255,077 | B2 | 8/2007 | Simpson et al. | |
| 7,685,980 | B2 * | 3/2010 | Lee et al. | 123/90.16 |
| 2005/0039713 | A1 | 2/2005 | Pierik | |
| 2006/0086332 | A1 | 4/2006 | Simpson et al. | |

FOREIGN PATENT DOCUMENTS

| | | |
|---|---|---|
| JP | 20040108370 | 4/2004 |
| WO | 2009005999 A1 | 1/2009 |

OTHER PUBLICATIONS

International Search Report for PCT/US2011/030250 mailed Nov. 16, 2011; 7 pages.

* cited by examiner

*Primary Examiner* — Zelalem Eshete
(74) *Attorney, Agent, or Firm* — Brown & Michaels, PC

(57) ABSTRACT

A camshaft assembly for extending duration of a valve event including a hollow outer shaft, an inner shaft received within the hollow outer shaft, a plurality of cam lobes, and a phaser located between the plurality of cam lobes approximately in the middle of the inner and outer shaft.

18 Claims, 29 Drawing Sheets

CAM PHASER CENTRALLY LOCATED ALONG CONCENTRIC CAMSHAFTS

REFERENCE TO RELATED APPLICATIONS

This application claims one or more inventions which were disclosed in Provisional Application No. 61/321,202 filed Apr. 6, 2010, entitled "CAM PHASER CENTRALLY LOCATED ALONG CONCENTRIC CAMSHAFTS". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of concentric camshafts. More particularly, the invention pertains to a cam phaser centrally located along the concentric camshaft.

2. Description of Related Art

Cam in cam systems are well know in the prior art. In prior art cam in cam systems, the camshaft has two shafts, one positioned inside of the other. The shafts are supported one inside of the other and are rotatable relative to one another for a limited axial distance.

SUMMARY OF THE INVENTION

A camshaft assembly for extending duration of a valve event including a hollow outer shaft, an inner shaft received within the hollow outer shaft, a plurality of cam lobes, and a phaser located between the plurality of cam lobes approximately in the middle of the inner and outer shaft.

In one embodiment, a phaser is attached to an end of the camshaft assembly.

DETAILED DESCRIPTION OF THE INVENTION

Figure 1:
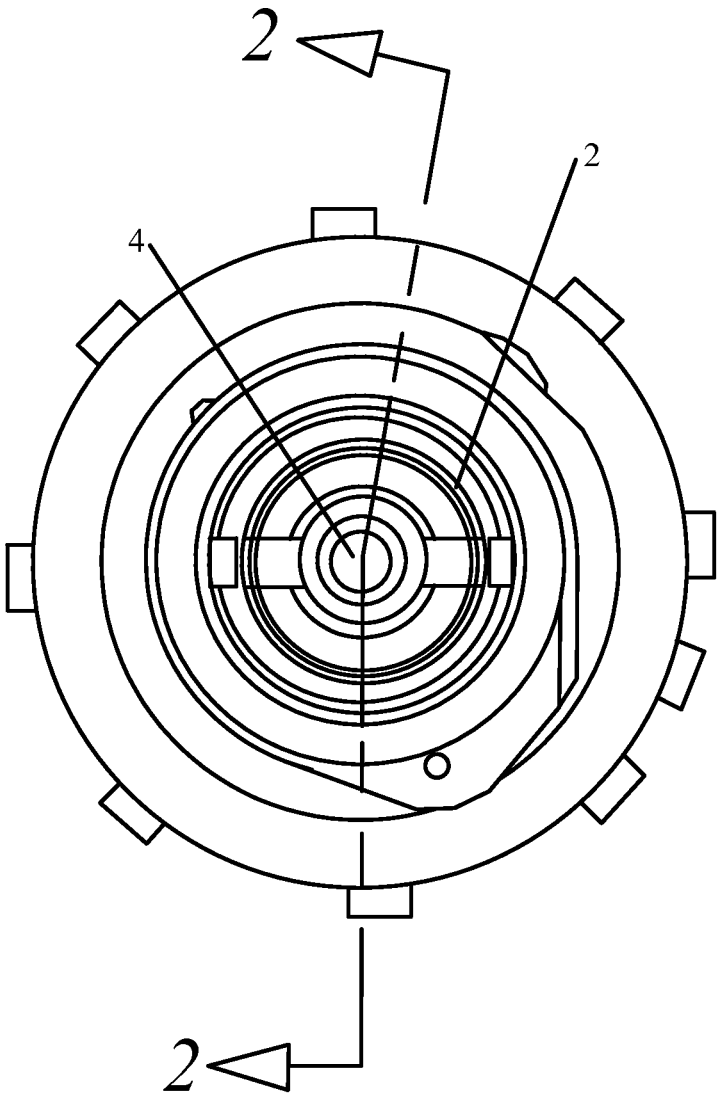
FIG. 1 shows a concentric camshaft with a centrally located valve event duration (VED) phaser of a first embodiment with the housing coupled to the inner shaft.
Figure 3:
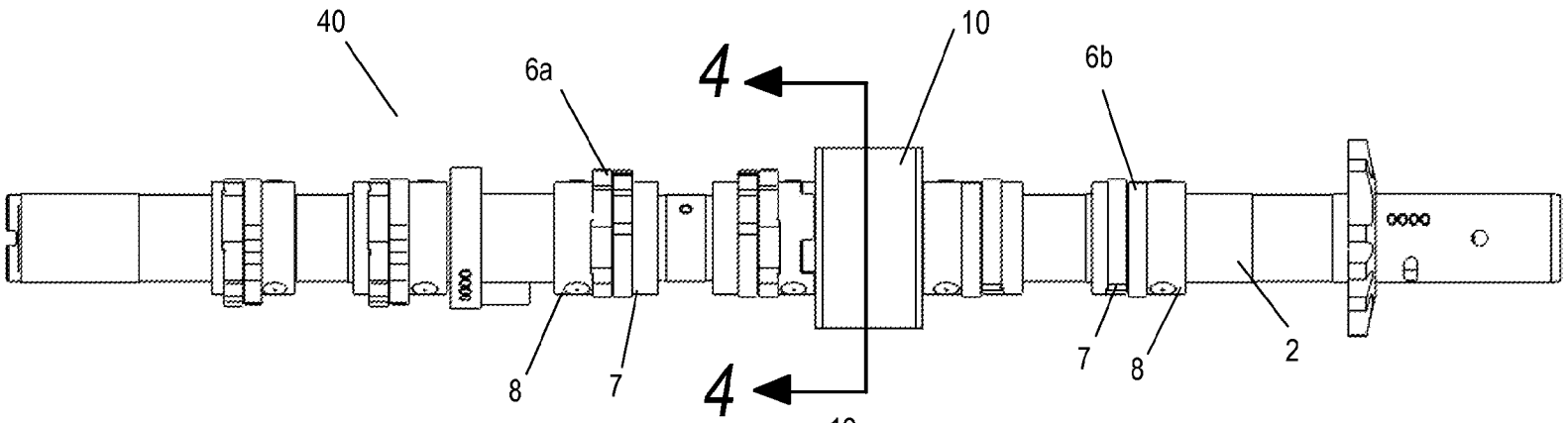
FIG. 3 shows another view of concentric camshaft with a centrally located valve event duration (VED) phaser of a first embodiment with the housing coupled to the inner shaft.
Figure 2:
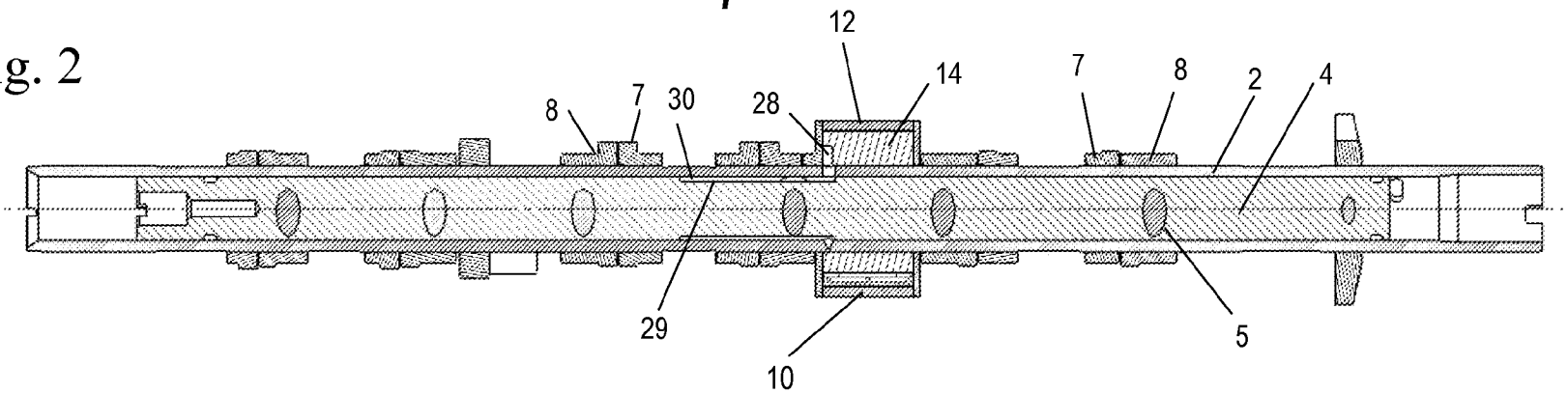
FIG. 2 shows a cross-section of the centrally located valve event duration (VED) phaser of the first embodiment along line 2-2 of FIG. 1.
Figure 4:
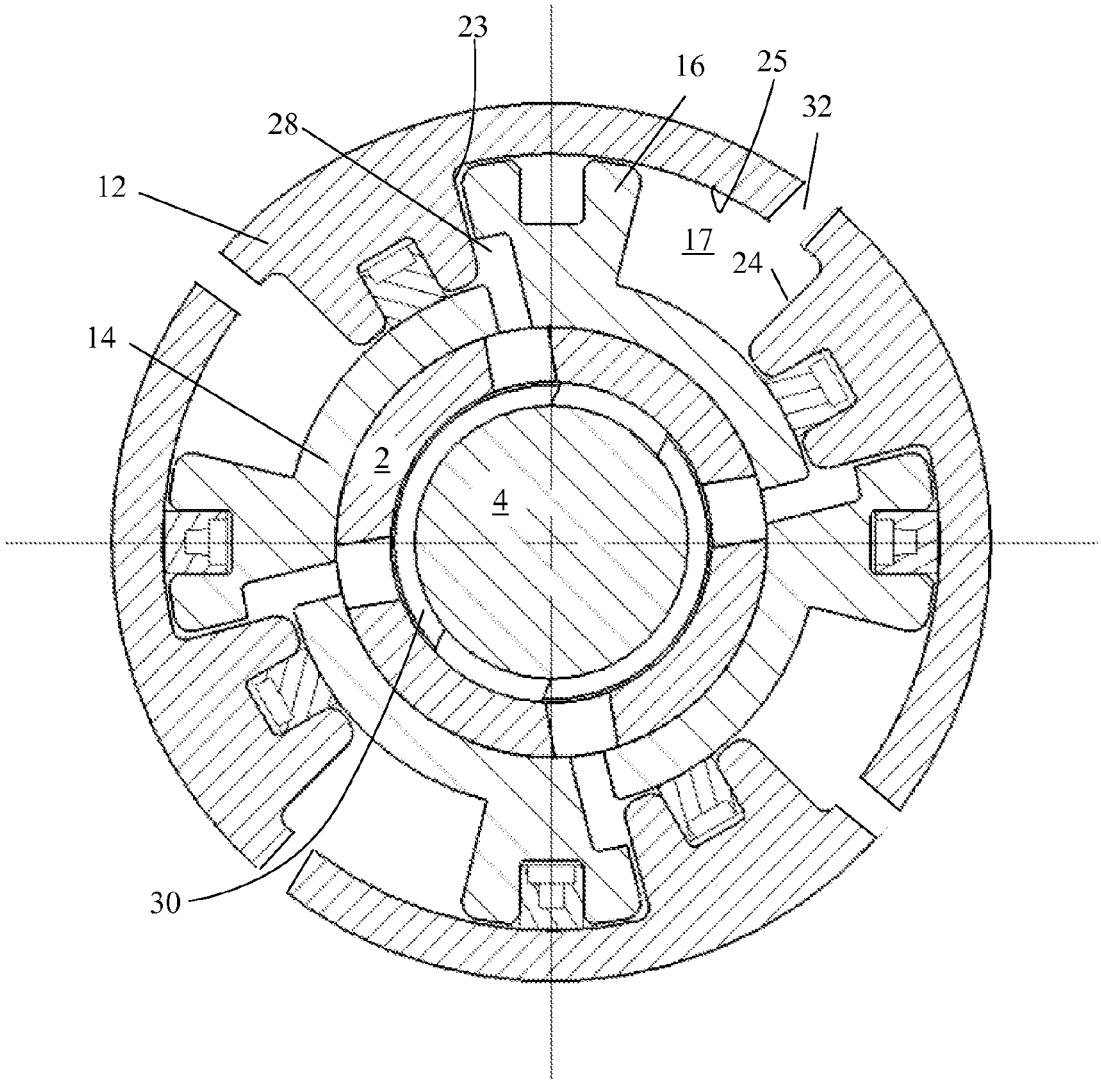
FIG. 4 shows a cross-section of the valve event duration (VED) phaser of the first embodiment along 4-4 of FIG. 3.
Figure 5:
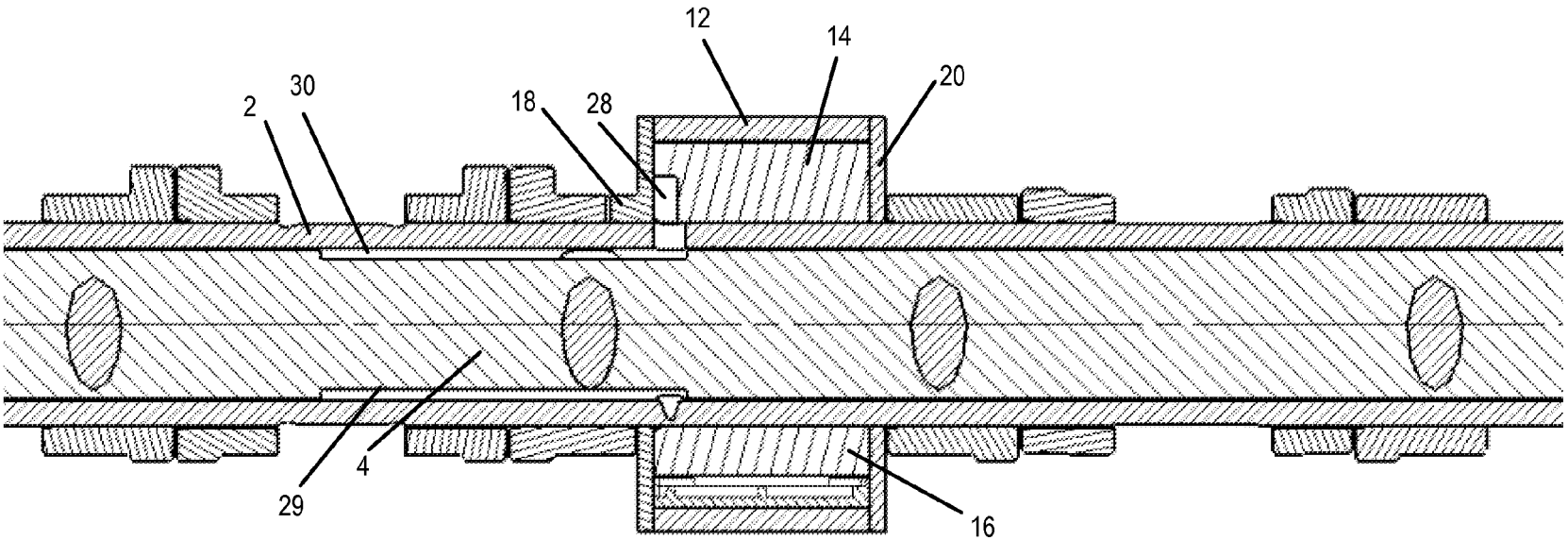
FIG. 5 shows a magnified view of the VED phaser of the first embodiment shown in FIG. 2.
Figure 6:
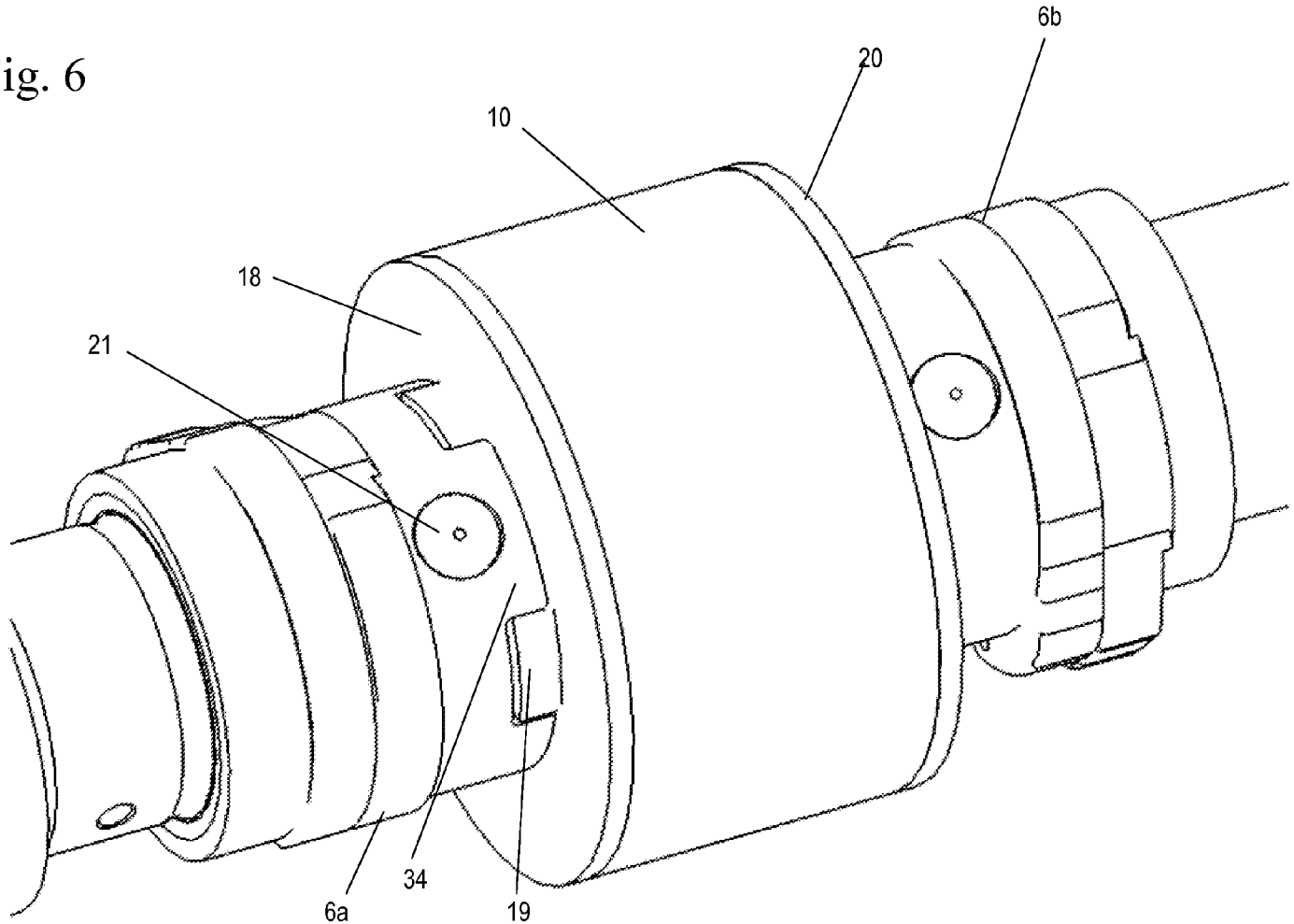
FIG. 6 shows a magnified view of the connection between the end plates of the valve event duration (VED) phaser and the adjacent cam lobes.

FIGS. 1-8 show a concentric camshaft with a valve event duration (VED) phaser 10 preferably centrally located along concentric camshaft of a first embodiment. The camshaft assembly 40 has an inner shaft 4 and a hollow outer shaft 2. The outer shaft has slots (not shown) along its length. The outer shaft 2 surrounds the inner shaft 4 and the inner shaft 4 rotates within the outer shaft 2. The inner shaft 4 has multiple holes 5 that run perpendicular to the length of the shaft. The inner shaft is placed within the outer shaft.

Figure 7:
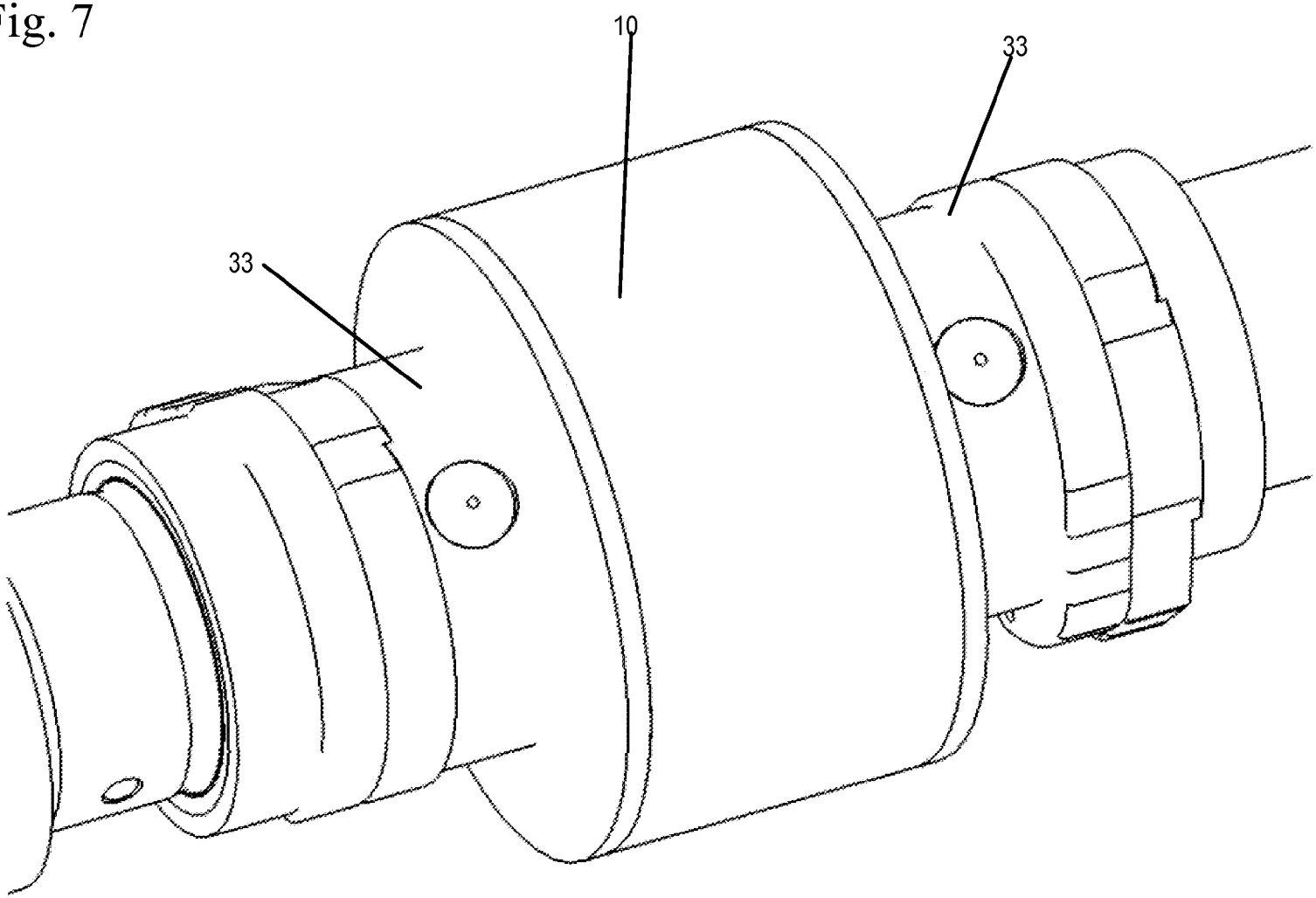
FIG. 7 shows a magnified view of an alternate embodiment of the connection between the end plates of the valve event duration (VED) phaser and the adjacent cam lobes.
Figure 8:
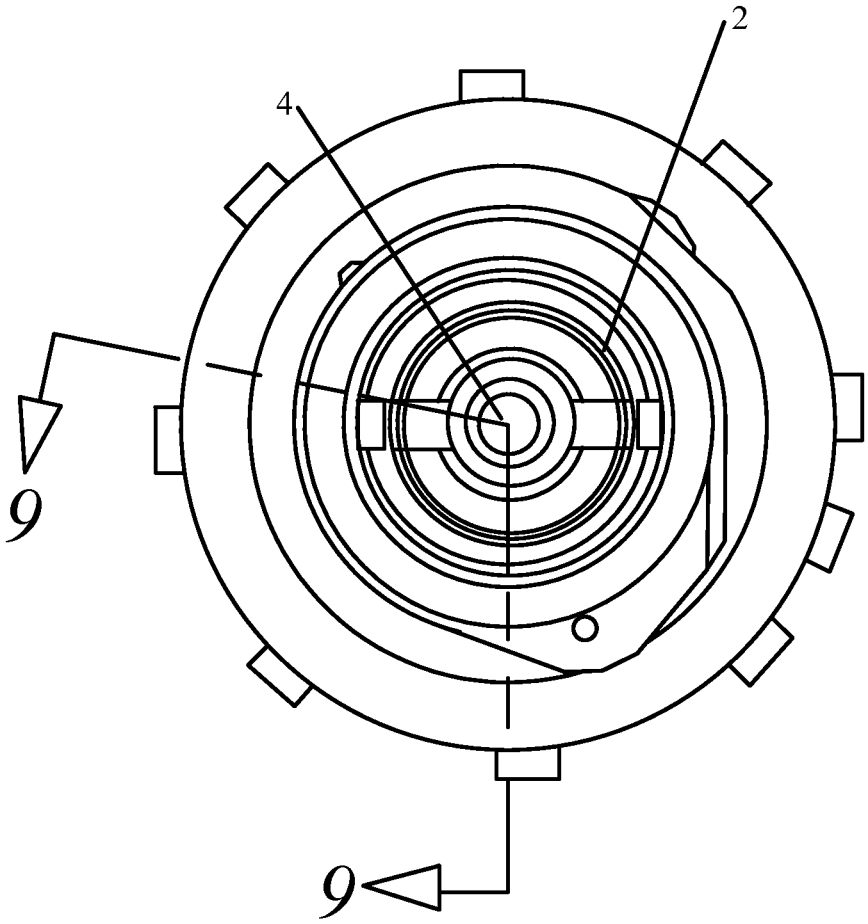
FIG. 8 shows a concentric camshaft with a centrally located valve event duration (VED) phaser of a second embodiment with the housing coupled to the outer shaft.
Figure 10:
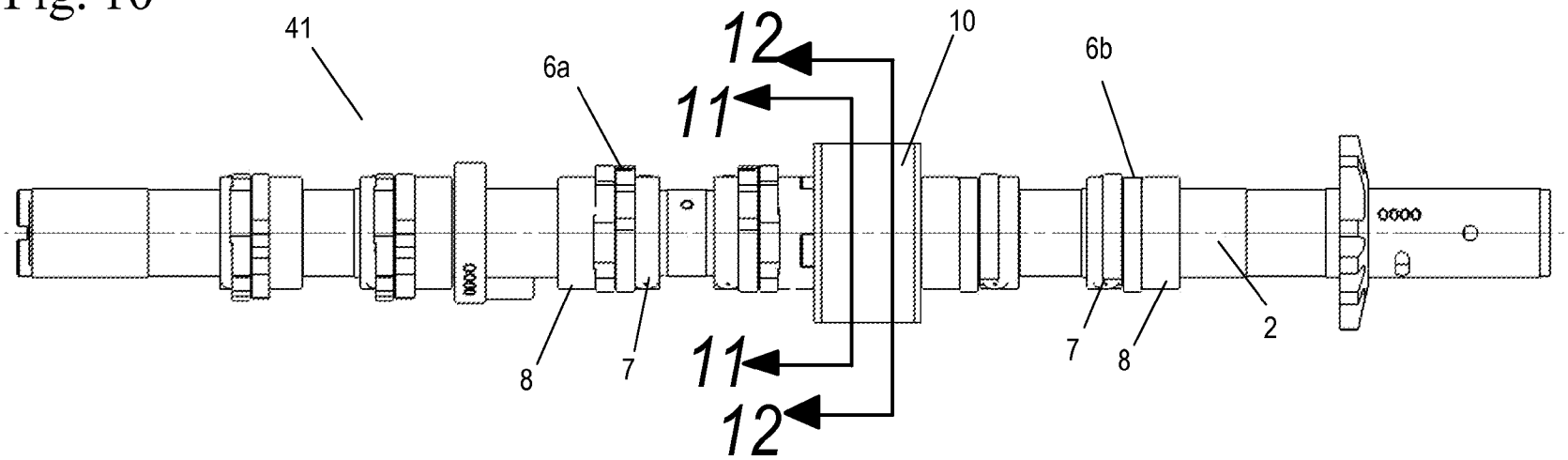
FIG. 10 shows another view of concentric camshaft with a centrally located valve event duration (VED) phaser of a second embodiment with the housing coupled to the outer shaft.
Figure 9:
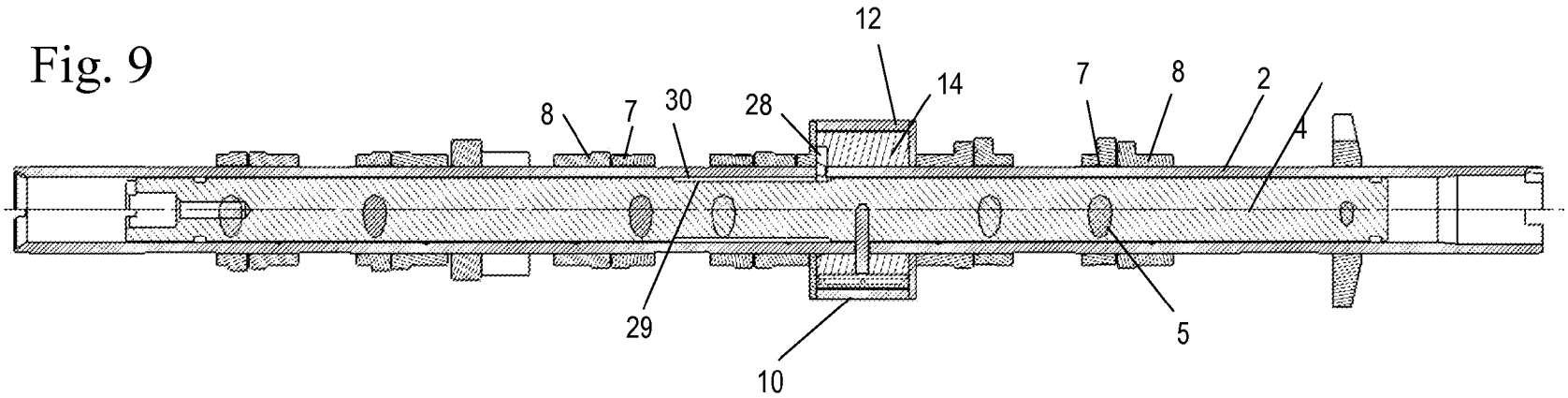
FIG. 9 shows a cross-section of the centrally located valve event duration (VED) phaser of the second embodiment along line 9-9 of FIG. 8.
Figure 11:
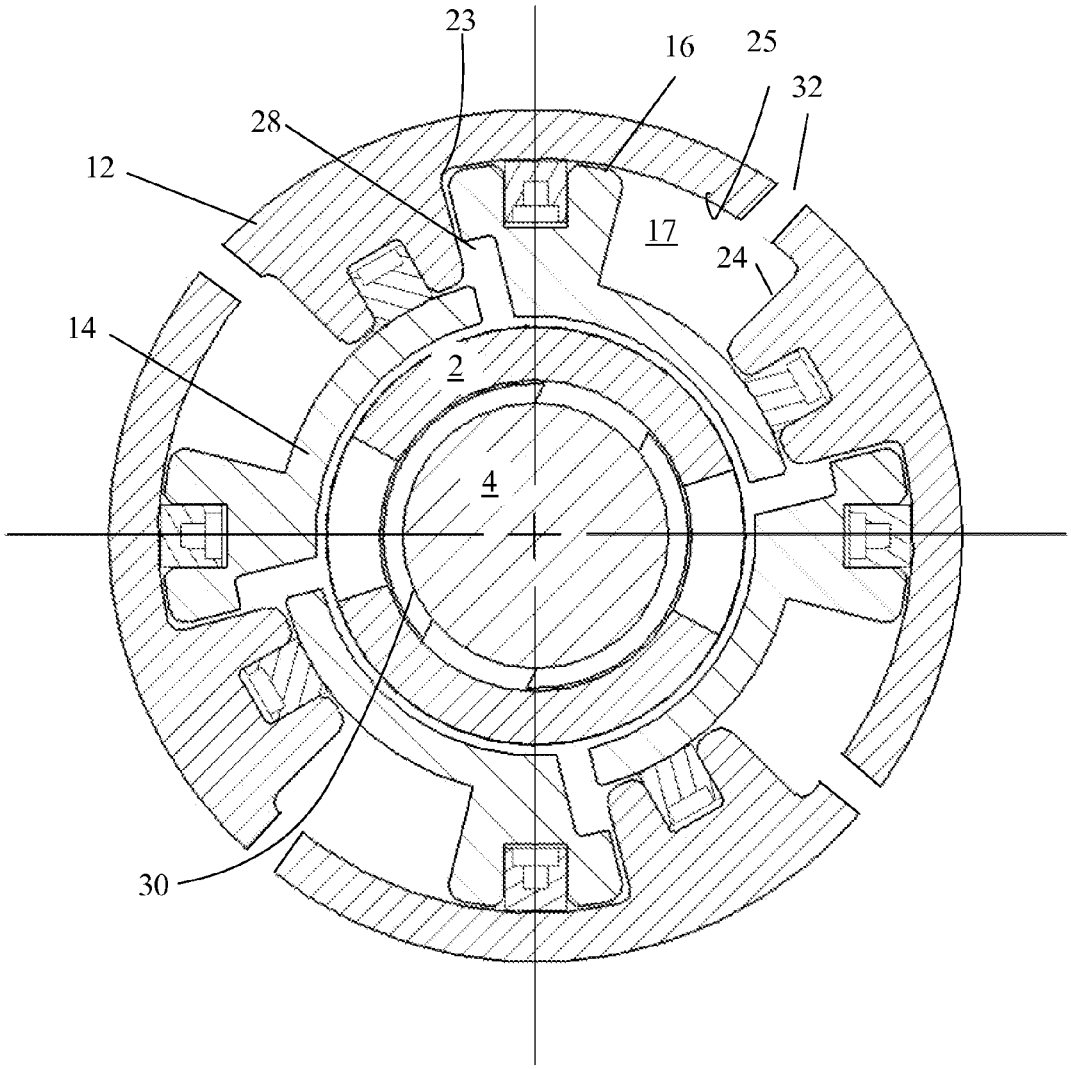
FIG. 11 shows a cross-section of the valve event duration (VED) phaser of the second embodiment along line 11-11 of FIG. 10.
Figure 12:
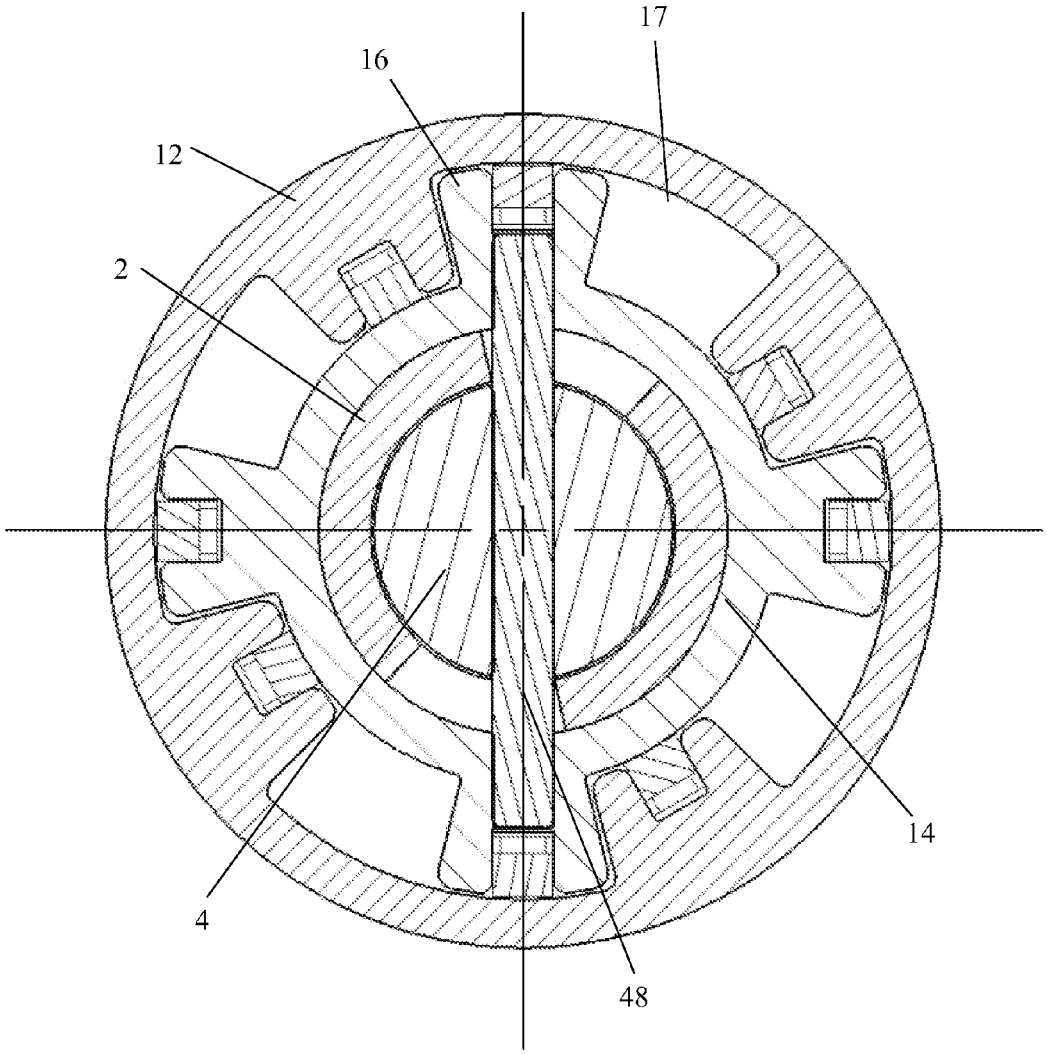
FIG. 12 shows another cross-section of the valve event duration (VED) phaser of the second embodiment along line 12-12 of FIG. 9.
Figure 13:
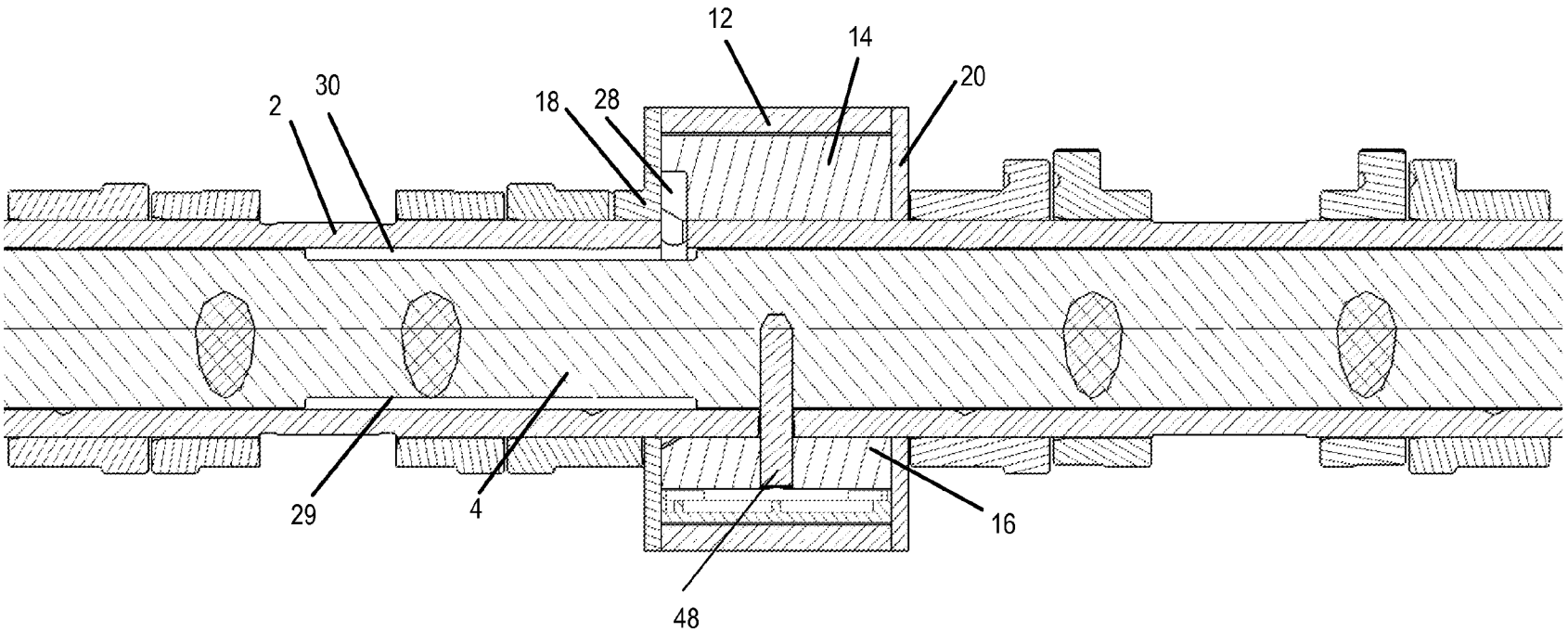
FIG. 13 shows a magnified view of the VED phaser of the second embodiment shown in FIG. 9.
Figure 14:
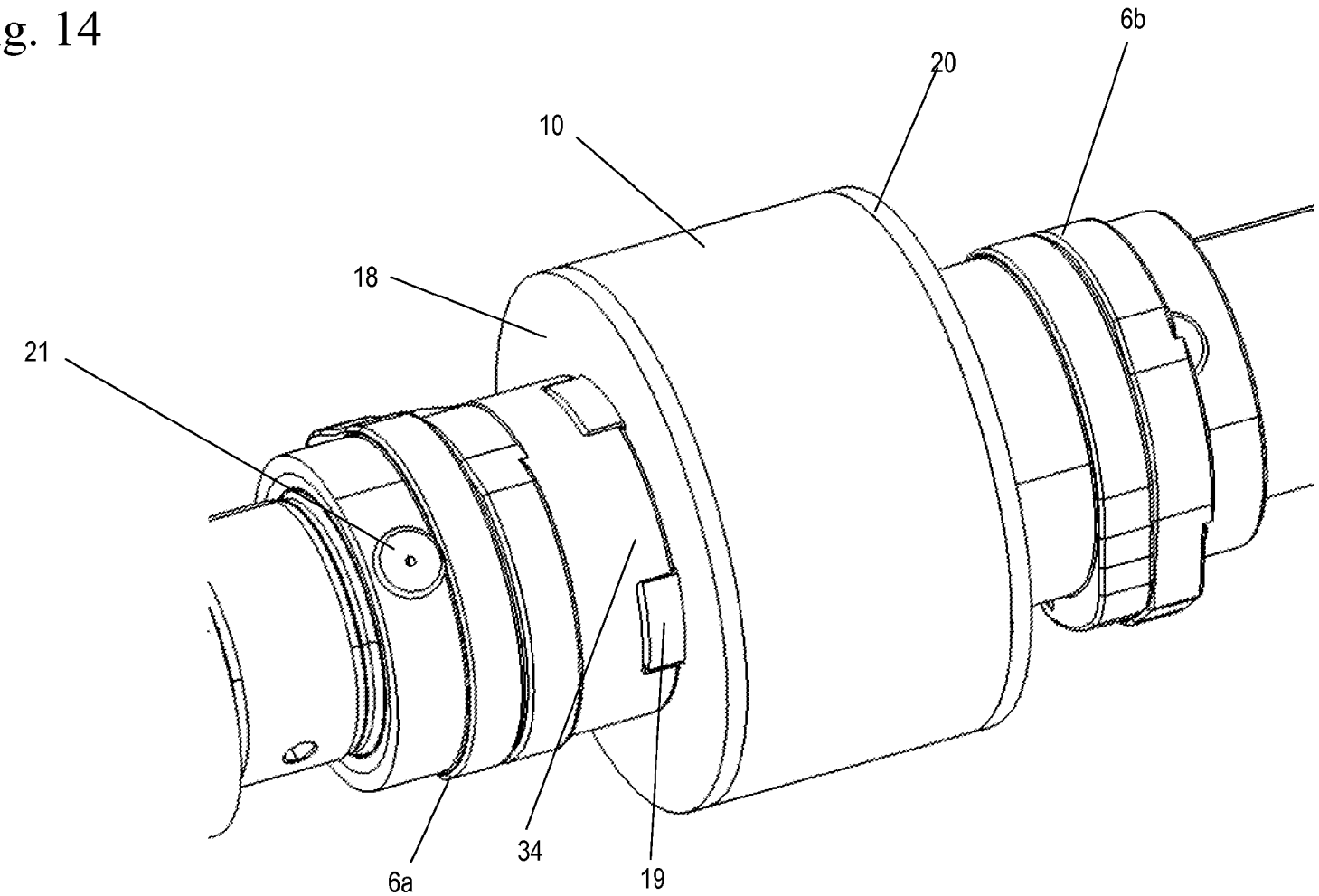
FIG. 14 shows a magnified view of the connection between the end plates of the valve event duration (VED) phaser and the adjacent cam lobes.

The cam lobes 6*a*, 6*b* along the concentric camshaft are preferably split into at least two additional lobes 7, 8, although three lobes are preferable. It should be noted that for explanation purposes, all cam lobes on one side of the VED phaser are labeled as 6*a* and all cam lobes on the other side of the VED phaser are labeled as 6*b*. One of the split lobes 7 is fixed in place and mounted to the outer shaft 2 and the other of the split lobes 8 is mounted to the inner shaft 4 through a mechanical connection such as a pin and moves relative to the stationary split lobe 7. One cam follower (not shown) interacts with both of the split lobes. In an alternate embodiment, the end plates and a part of the split cam is formed as one piece 33 as shown in FIG. 7.

A valve event duration (VED) phaser 10 is preferably located approximately in the middle of the camshaft assembly 40 between two lobes 6*a*, 6*b*. The VED phaser 10 includes a housing 12 connected to the inner shaft 4 through the movable portions 7 of the lobes 6*a*, 6*b*. The housing surrounds a rotor 14 which is pressed or welded onto the outer shaft 2. The rotor 14 has a series of vanes 16 which are received within chambers 17 formed between the first wall 23, the second wall 24, the inner diameter 25 of the housing 12 and the rotor 14. A vent 32 is present in the chamber 17. On one side of each vane is an oil feed channel 28. On either side of the housing 12 and rotor 14 are end plates 18, 20, one or both of which includes drive keys 19. The end plates 18, 20 are preferably welded to the housing 12. The drive keys 19 on one or both of the end plates 18, 20 interact and couple with drive keys 34 of movable split lobes 7 of the cam lobes 6*a*, 6*b* that are pinned 21 to the inner shaft 4.

A passage or groove 30 is cut on the inner shaft 4 and leads to an oil feed channel 28 on the vanes 16. A chamber 29 is formed between the inner diameter of the outer shaft 2 and the passage or groove 30 on the inner shaft 4. Through a bearing (not shown) on the outer shaft 2, a valve (not shown) provides fluid to the chamber 29 and to the oil feed channel 28 of the vanes 16 of the rotor 14. When the chamber 29 is pressurized, fluid moves into the oil feed channel 28 of the vane 16 and the chamber 17 formed between the housing 12 and the rotor 14, moving the vane 16 towards the second wall 24 of the chamber 17, moving the split lobes 6 connected to outer shaft 2 relative to the split lobes 7 connected to the inner shaft 4, extending the duration of the valve event.

The VED phaser 10 has at least three states, a holding state, a valve event duration extended state, and an initial state, allowing a range of positions of the VED phaser and the lobes. In the initial state, the vanes 16 are adjacent the first wall 23 of the chamber 17 formed between the rotor 14 and the housing 12 and fluid is vented from the chamber 29 formed between the outer shaft 2 and the inner shaft 4 and the oil feed channel 28 on the vane 16 through the valve (not shown).

In a valve event duration extended state, fluid is supplied to the chamber 29 formed between the outer shaft 2 and the inner shaft 4 and the oil feed channel 28 on the vane 16, pressurizing the chamber 29 and moving the vane 16 towards the second wall 24. In the valve event duration extended state, the vane 16 may be moved until the vane 16 encounters the second wall 24 or to position in between the first wall 23 and the second wall 24. The valve event duration is extended by an amount based on the rotation of the vane 16 and the position of the vane 16 relative to the second wall 24.

A holding state may be present when the chamber 29 is pressurized and the valve (not shown) is moved to a position in which fluid is neither being supplied nor vented to the chamber 29. In this state, the valve event duration is maintained.

Unless the VED phaser 10 is being held, or moved to a valve event duration state, the valve (not shown) is moved to a venting position and torque on the concentric camshafts generated by the shape of the lobes 6, 7 moves the inner shaft 4 coupled to the housing 12. The torque is only present in one direction on the movable inner shaft 4. As the torque rotates the inner shaft 4, the drive keys 19 on one or both of the end plates 18, 20 connected to the housing 12 rotate, moving the housing 12 relative to the rotor 14 back to the initial position in which the vanes 16 are adjacent the first wall 23 of the chamber 17 formed between the housing 12 and the rotor 14 and the moveable cam noses 26 of the split lobes coupled to the housing 12 are rotated into alignment with the stationary cam noses 27 of the split lobes 6, 7 coupled to the rotor 14.

The VED phaser 10 may be oil pressure actuated where engine oil pressure is applied to one side of the vane, with or without a check valve present in the oil supply line or in the supply line to each chamber. The check valve blocks oil pressure pulses due to torque fluctuating from propagating back into the oil system, and stops the vane from moving backward due to torque fluctuating.

In this concentric camshaft, the torque present is only in one direction and is present only on the inner shaft 4.

Centrally locating the VED phaser 10 in the between two lobes along the concentric camshafts shortens the effective length of the inner shaft and reduces the torsional deflection on the inner shaft.

VED phaser does not require any bolts in construction. The phaser is held together by welds or brazing. Additionally a lock pin is not necessary since only unidirectional torque is present on the moveable shaft.

FIGS. 8-15 show a concentric camshaft with a centrally located valve event duration (VED) phaser 10 of a second embodiment.

The camshaft assembly 41 has an inner shaft 4 and a hollow outer shaft 2. The outer shaft 2 surrounds the inner shaft 4 and the inner shaft 4 rotates within the outer shaft 2. The inner shaft 4 has multiple holes 5 that run perpendicular to the length of the shaft.

The cam lobes 6*a*, 6*b* along the concentric camshaft are preferably split into at least two additional lobes 7, 8, although three lobes are preferable. It should be noted that for explanation purposes, all cam lobes on one side of the VED phaser are labeled as 6*a* and all cam lobes on the other side of the VED phaser are labeled as 6*b*. One of the split lobes 7 is fixed in place and mounted to the outer shaft 2 and the other of the split lobes 8 is mounted to the inner shaft 4 through a mechanical connection such as a pin and moves relative to the stationary split lobe 7. One cam follower (not shown) interacts with both of the split lobes.

Figure 15:
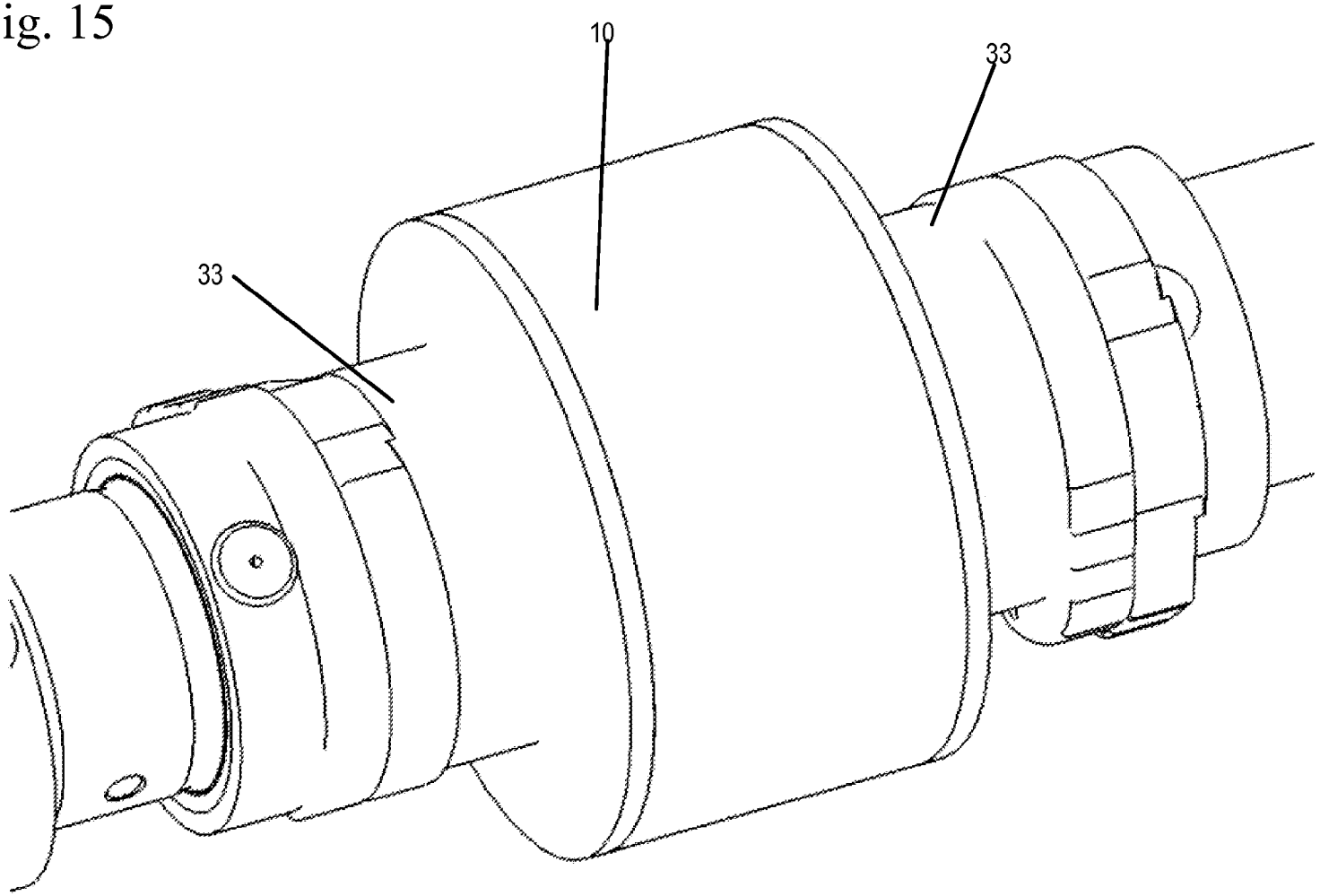
FIG. 15 shows a magnified view of an alternate embodiment of the connection between the end plates of the valve event duration (VED) phaser and the adjacent cam lobes
Figure 16:
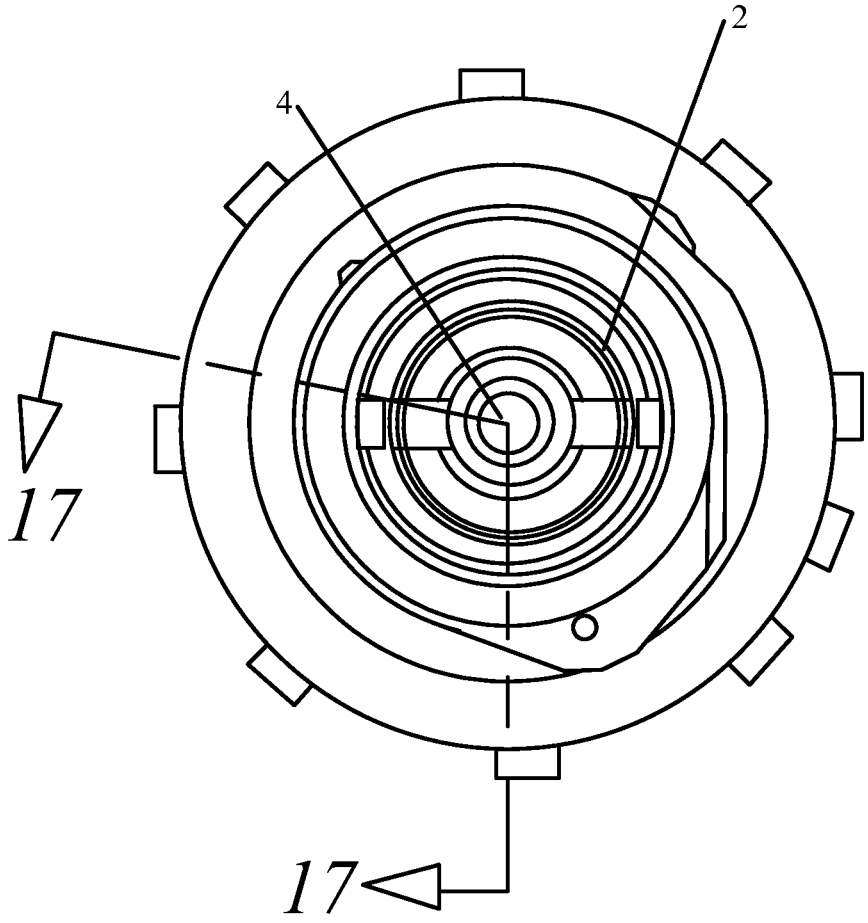
FIG. 16 shows a concentric camshaft with a centrally located valve event duration (VED) phaser of a third embodiment in which the concentric camshaft is split into two pieces and is connected through the VED phaser.
Figure 18:
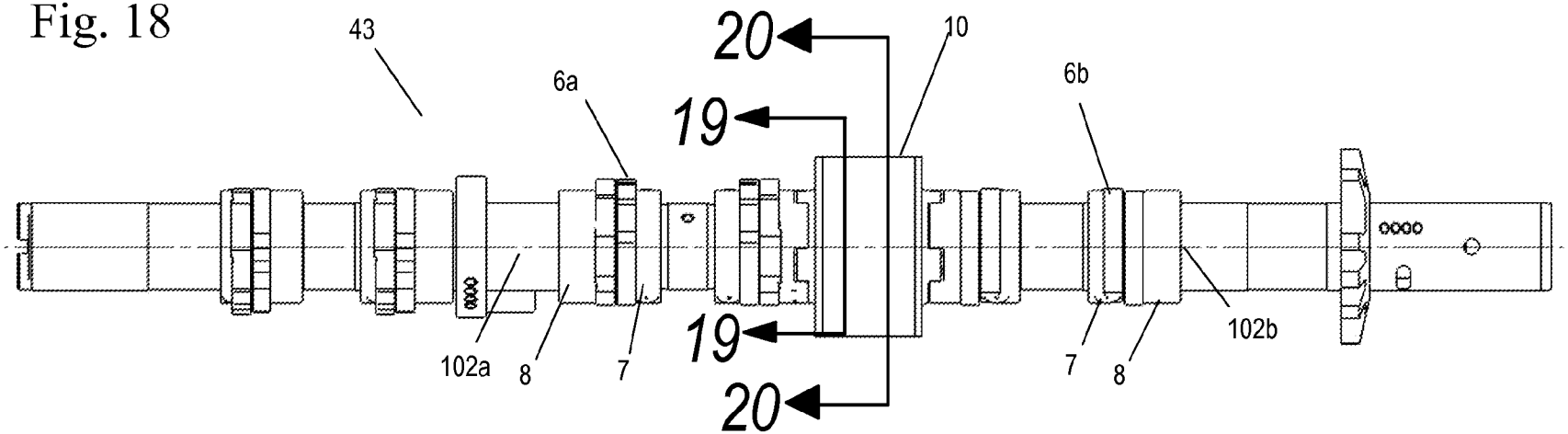
FIG. 18 shows another view of concentric camshaft with a centrally located valve event duration (VED) phaser of a third embodiment in which the concentric camshaft is split into two pieces and is connected through the VED phaser.
Figure 17:
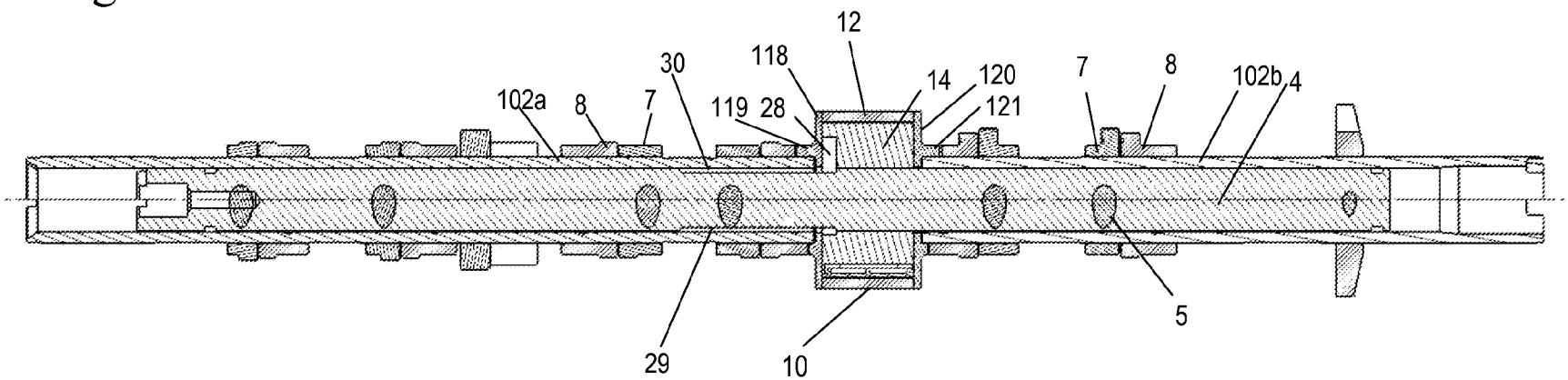
FIG. 17 shows a cross-section of the centrally located valve event duration (VED) phaser of the second embodiment along line 17-17 of FIG. 16.
Figure 19:
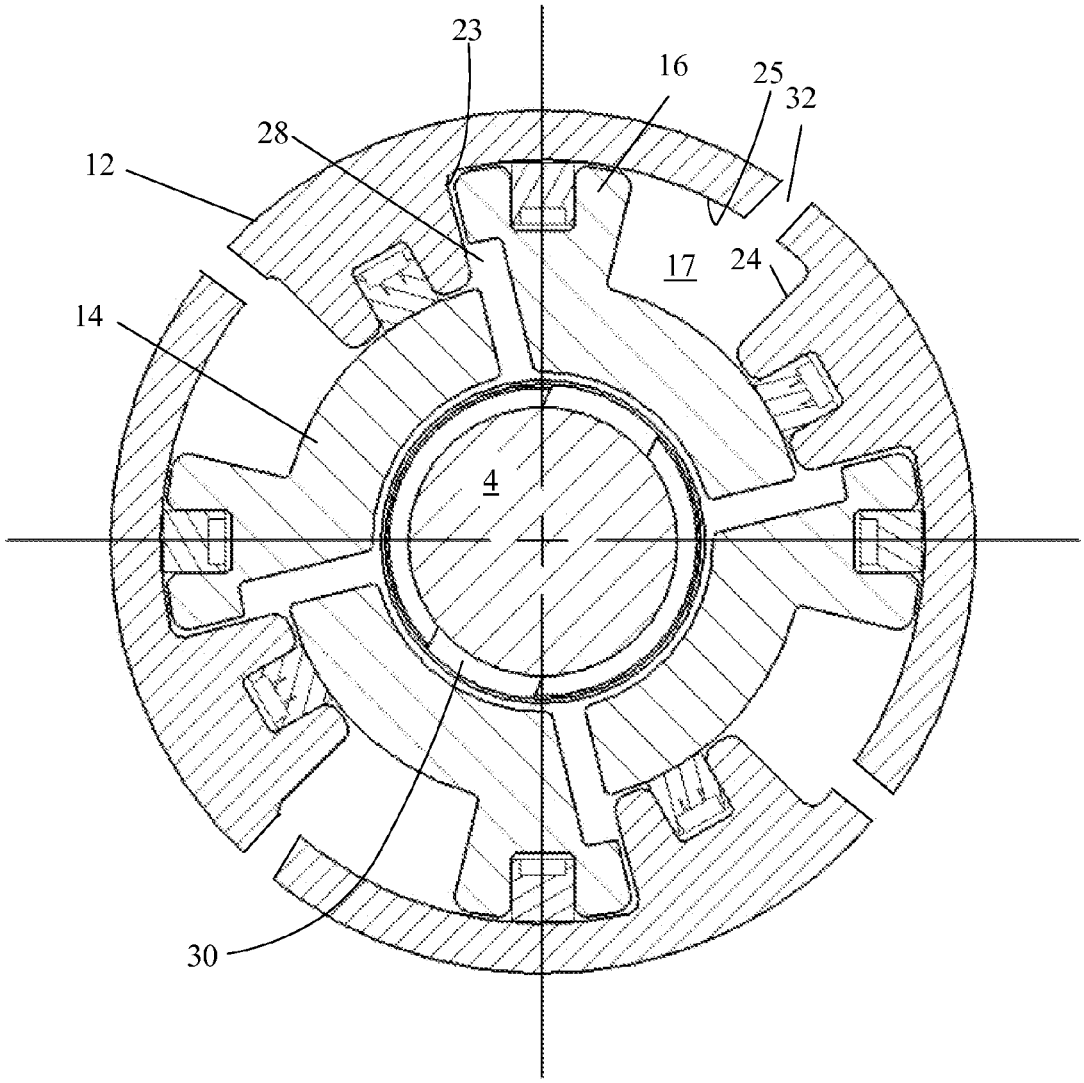
FIG. 19 shows a cross-section of the valve event duration (VED) phaser of the third embodiment along line 19-19 of FIG. 18.
Figure 20:
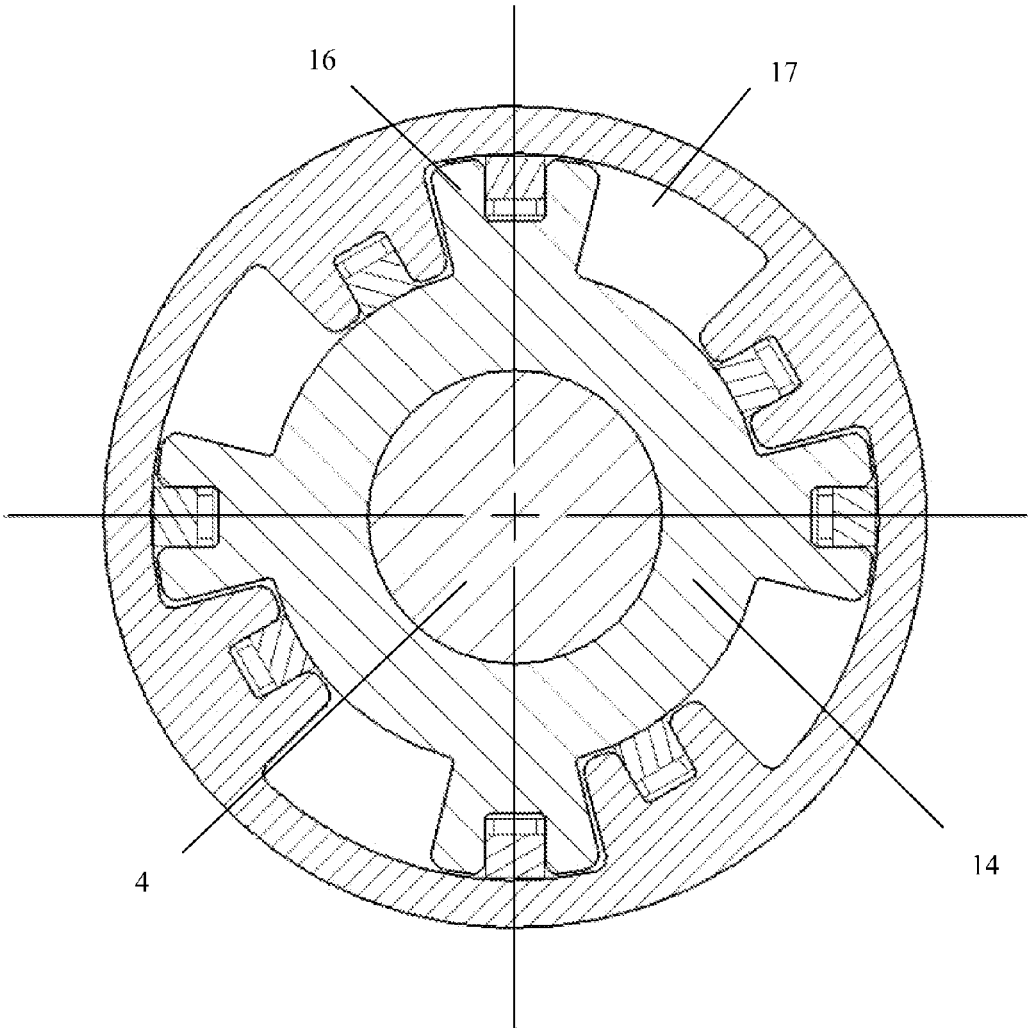
FIG. 20 shows a cross-section of the valve event duration (VED) phaser of the third embodiment along line 20-20 of FIG. 18.
Figure 21:
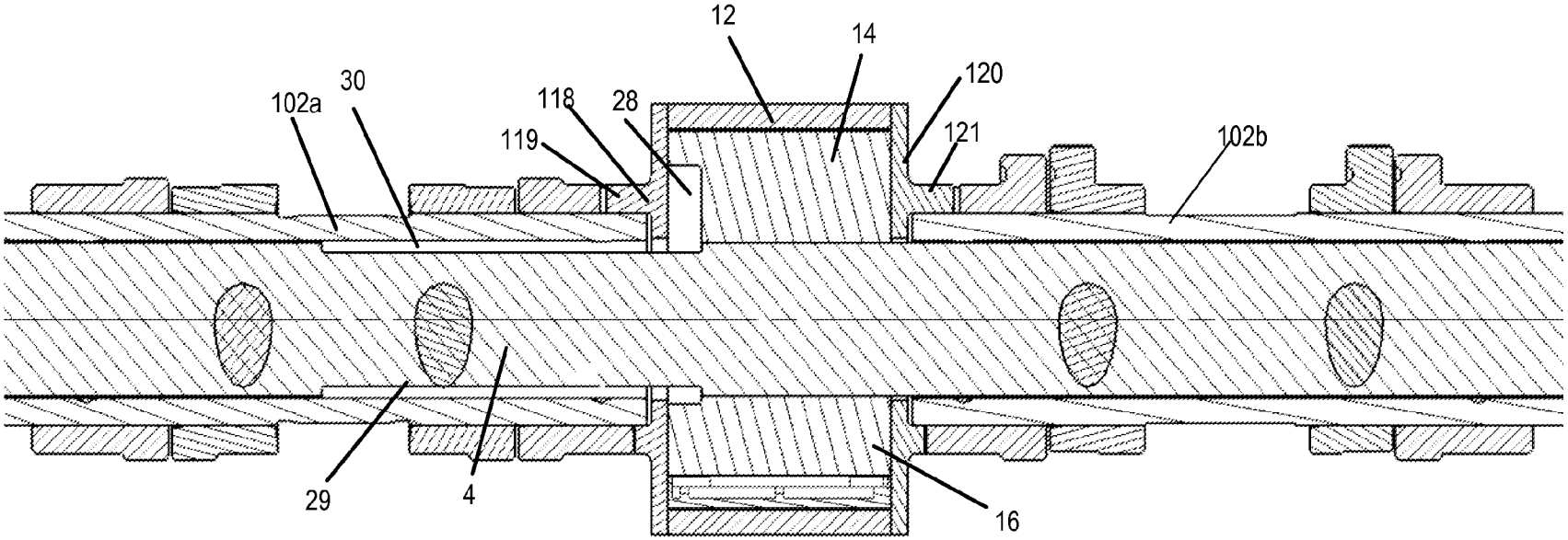
FIG. 21 shows a magnified view of the VED phaser of the third embodiment shown in FIG. 17.
Figure 22:
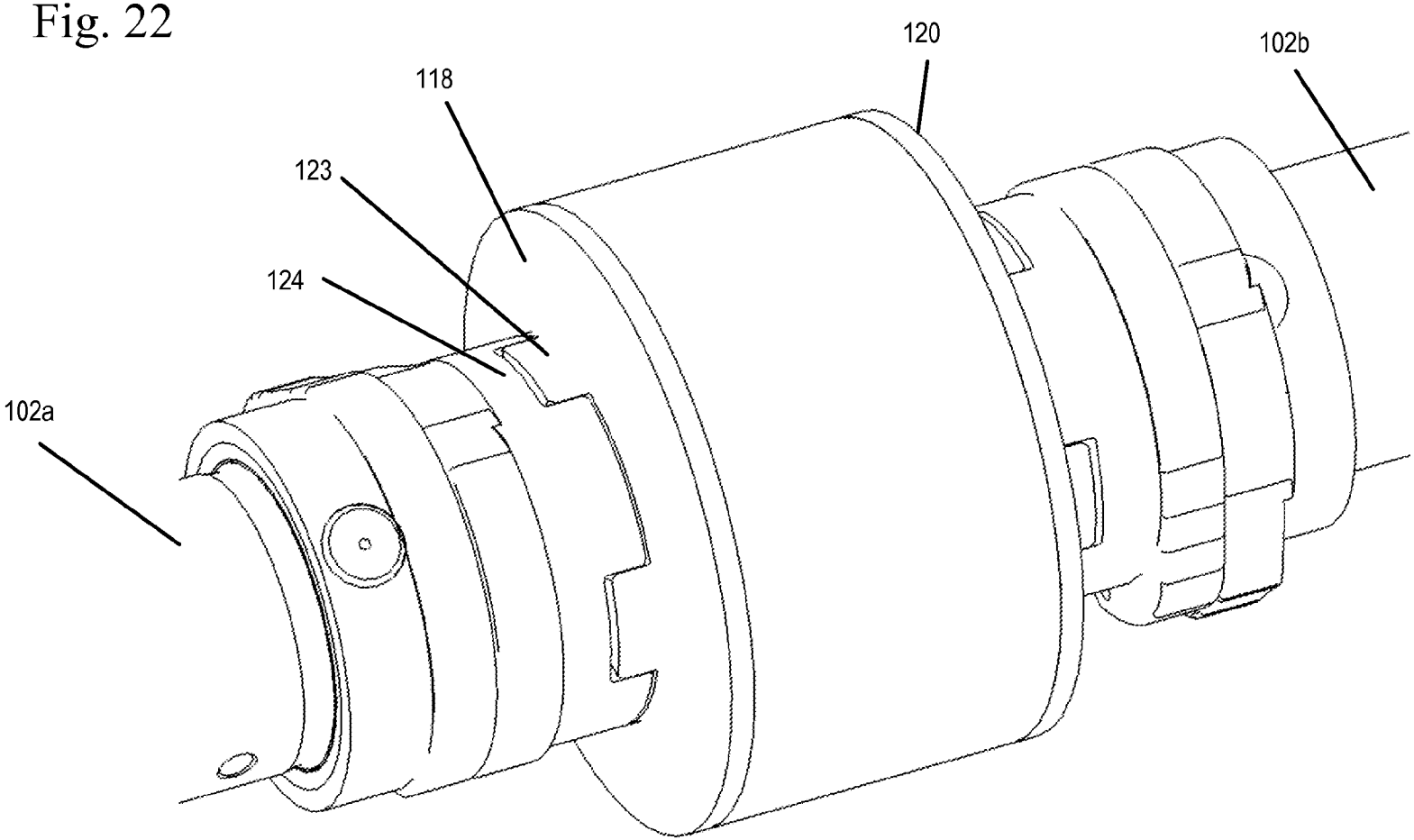
FIG. 22 shows a magnified view of the connection between the end plates of the valve event duration (VED) phaser and the adjacent cam lobes.

A valve event duration (VED) phaser 10 is located between two lobes 6*a*, 6*b* on the camshaft assembly 41. The VED phaser 10 includes a housing 12 connected to the outer shaft 2 through stationary lobes 6 and a rotor 14 connected to the movable portions 7 of the lobes 6*a*, 6*b*. The rotor 14 has a series of vanes 16 which are received within chambers 17 formed between the first wall 23, the second wall 24, the inner diameter 25 of the housing 12 and the rotor 14. A vent 32 is present in the chamber 17. On one side of each vane is an oil feed channel 28. The rotor 14 is connected to the inner shaft 4 through a pin 40 running through at least two of the vanes 16. On either side of the housing 12 and rotor 14 are end plates 18, 20 with drive keys 19. The end plates 18, 20 are preferably welded to the housing 12. The drive keys 19 of each of the end plates 18, 20 interact and couple with drive keys 34 of movable split lobes 7 of the cam lobes 6*a*, 6*b* that are pinned 21 to the inner shaft 4. In an alternate embodiment, the end plates and a part of the split cam is formed as one piece 33 as shown in FIG. 15.

A passage or groove 30 is cut on the inner shaft 4 and leads to an oil feed channel 28 on the vanes 16. A chamber 29 is formed between the inner diameter of the outer shaft 2 and the passage or groove 30 on the inner shaft 4. Through a bearing (not shown) on the outer shaft 2, a valve (not shown) provides fluid to the chamber 29 and to the oil fed channel 28 of the vanes 16 of the rotor 14. When the chamber 29 is pressurized, fluid moves into the oil feed channel 28 of the vane 16 and the chamber 17 formed between the housing 12 and the rotor 14, moving the vane 16 towards the second wall 24 of the chamber 17, moving the split lobes 6 connected to outer shaft 2 relative to the split lobes 7 connected to the inner shaft 4, extending the duration of the valve event.

The VED phaser 10 has at least three states, a holding state, a valve event duration extended state, and an initial state, allowing a range of positions of the VED phaser and the lobes. In the initial state, the split lobes 6, 7 are aligned such that the cam noses 26, 27 of the split lobes are aligned with each other and the vanes 16 are adjacent the first wall 23 of the chamber 17 formed between the rotor 14 and the housing 12 and fluid is vented from the chamber 29 formed between the outer shaft 2 and the inner shaft 4 and the oil feed channel 28 on the vane 16 through the valve (not shown).

In a valve event duration extended state, fluid is supplied to the chamber 29 formed between the outer shaft 2 and the inner shaft 4 and the oil feed channel 28 on the vane 16, pressurizing the chamber 29 and moving the vane 16 towards the second wall 24. In the valve event duration extended state, the vane 16 may be moved until the vane 16 encounters the second wall 24 or to position in between the first wall 23 and the second wall 24. The valve event duration is extended by an amount based on the rotation of the vane 16 and the position of the vane 16 relative to the second wall 24.

A holding state may be present when the chamber 29 is pressurized and the valve (not shown) is moved to a position in which fluid is neither being supplied nor vented to the chamber 29. In this state, the valve event duration is maintained.

Unless the VED phaser 10 is being held, or moved to a valve event duration extended state, the valve (not shown) is moved to a venting position and torque on the concentric camshafts generated by the shape of the lobes 6, 7 moves the inner shaft 4 coupled to the housing 12. The torque is only present in one direction on the movable inner shaft 4. As the torque rotates the inner shaft 4, the rotor 14 is moved relative to the housing 12 and back to the initial state in which the vanes 16 are adjacent the first wall 23 of the chamber 17 formed between the housing 12 and the rotor 14 and the moveable cam noses 26 of the split lobes coupled to the rotor 14 are rotated into alignment with the stationary cam noses 27 of the split lobes 6, 7 coupled to the housing 12.

The VED phaser 10 may be oil pressure actuated where engine oil pressure is applied to one side of the vane, with or without a check valve present in the oil supply line or in the supply line to each chamber. The check valve blocks oil pressure pulses due to torque fluctuating from propagating back into the oil system, and stops the vane from moving backward due to torque fluctuating.

In this concentric camshaft, the torque present is only in one direction and is present only on the inner shaft 4.

Centrally locating the VED phaser 10 in the between two lobes along the concentric camshafts shortens the effective length of the inner shaft and reduces the resonance and torsional deflection on the inner shaft.

VED phaser does not require any bolts in construction. The phaser is held together by welds or brazing. Additionally a lock pin is not necessary since only unidirectional torque is present on the moveable shaft.

FIGS. 16-22 show a camshaft assembly 42 in which the outer shaft has been split into two pieces 102*a*, 102*b* and is joined together by the valve event duration (VED) phaser 10. The camshaft assembly 42 has an inner shaft 4 and two hollow outer shafts, 102*a* and 102*b*. The hollow outer shafts 102*a*, 102*b* each surround the inner shaft 4 and the inner shaft 4 rotates within the outer shafts 102*a*, 102*b*. The inner shaft 4 has multiple holes 5 that run perpendicular to the length of the shaft.

The cam lobes 6*a*, 6*b* along the concentric camshaft are preferably split into at least two additional lobes 7, 8, although three lobes are preferable. It should be noted that for explanation purposes, all cam lobes on one side of the VED phaser are labeled as 6*a* and all cam lobes on the other side of the VED phaser are labeled as 6*b*. One of the split lobes 7 is fixed in place and mounted to the outer shaft 2 and the other of the split lobes 8 is mounted to the inner shaft 4 through a mechanical connection such as a pin and moves relative to the stationary split lobe 7. One cam follower (not shown) interacts with both of the split lobes. In an alternate embodiment, the end plates and the split cam 33 are one piece.

A valve event duration (VED) phaser 10 is located between two lobes 6*a*, 6*b* on the camshaft assembly 42. The VED phaser 10 includes a housing 12 directly connected to the hollow outer shafts 102*a* and 102*b* through flanges 119, 121 integrally formed on the end plates 118 and 120 respectively. In an alternate embodiment, the end plates 118, 120 may be keyed 123 and the hollow outer shafts 102*a*, 102*b* may be keyed 124 to mesh with the other. The housing 12 is connected to stationary lobes 6 through the outer shafts 102*a*, 102*b*.

Within the VED phaser 10 is a rotor 14 connected to the movable portions 7 of the lobes 6*a*, 6*b*. The housing 12 surrounds the rotor 14. The rotor 14 is press fit onto the inner shaft 4, connecting the inner shaft 4 to the rotor 14. Alternatively, a pin may connect the inner shaft 4 to the rotor 14. The rotor 14 has a series of vanes 16 which are received within chambers 17 formed between the first wall 23, the second wall 24, the inner diameter 25 of the housing 12 and the rotor 14. A vent 32 is present in the chamber 17. On one side of each vane is an oil feed channel 28. On either side of the housing 12 and rotor 14 are end plates 18, 20 one or both of which includes drive keys 19. The end plates 18, 20 are preferably welded to the housing 12. The drive keys 19 on one or both of the end plates 18, 20 interact and couple with drive keys 34 of movable split lobes 7 of the cam lobes 6*a*, 6*b* that are pinned 21 to the inner shaft 4. In an alternate embodiment, the end plates and the split cam 33 are one piece.

Figure 23:
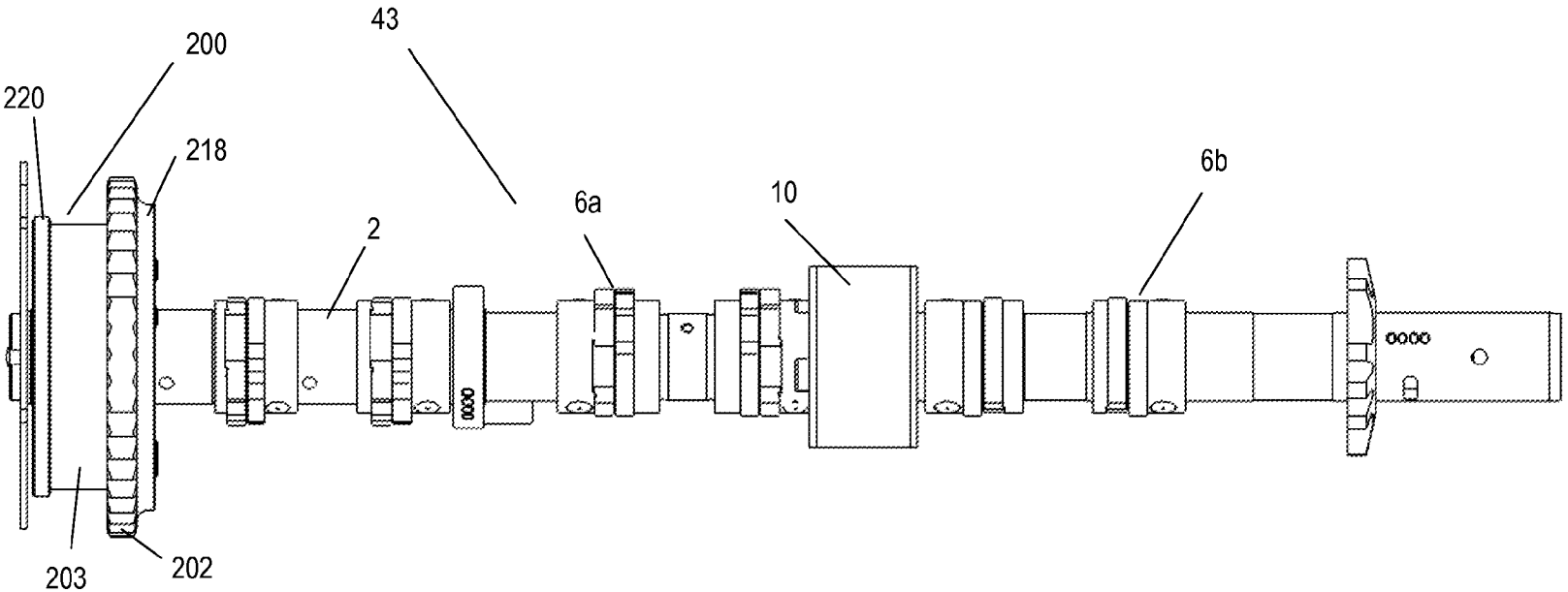
FIG. 23 shows a concentric camshaft with a centrally located valve event duration (VED) phaser and a variable cam timing (VCT) phaser at an end of a fourth embodiment.
Figure 24:
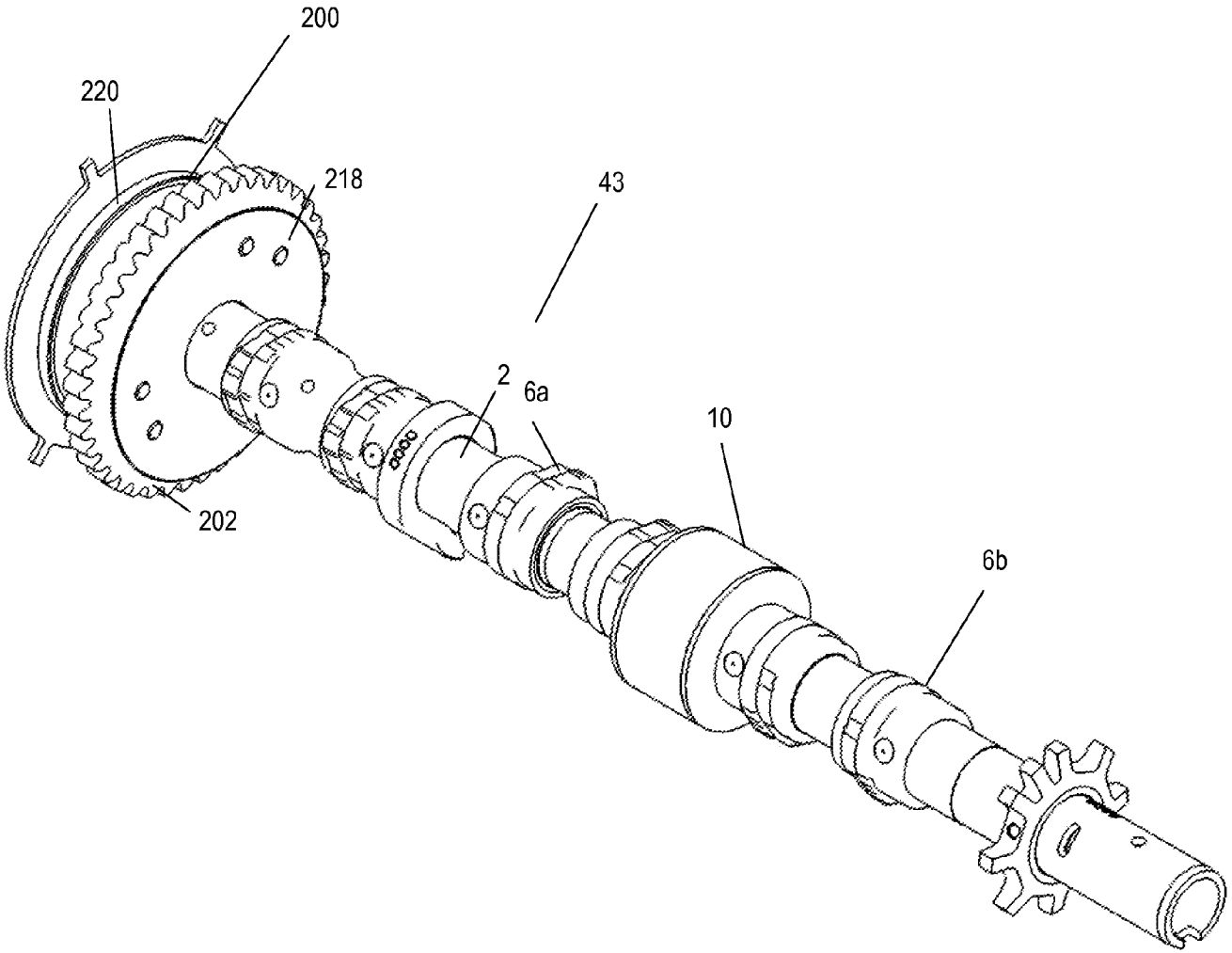
FIG. 24 shows an isometric view of a concentric camshaft with a centrally located valve event duration (VED) phaser and a variable cam timing (VCT) phaser at an end of a fourth embodiment.
Figure 25:
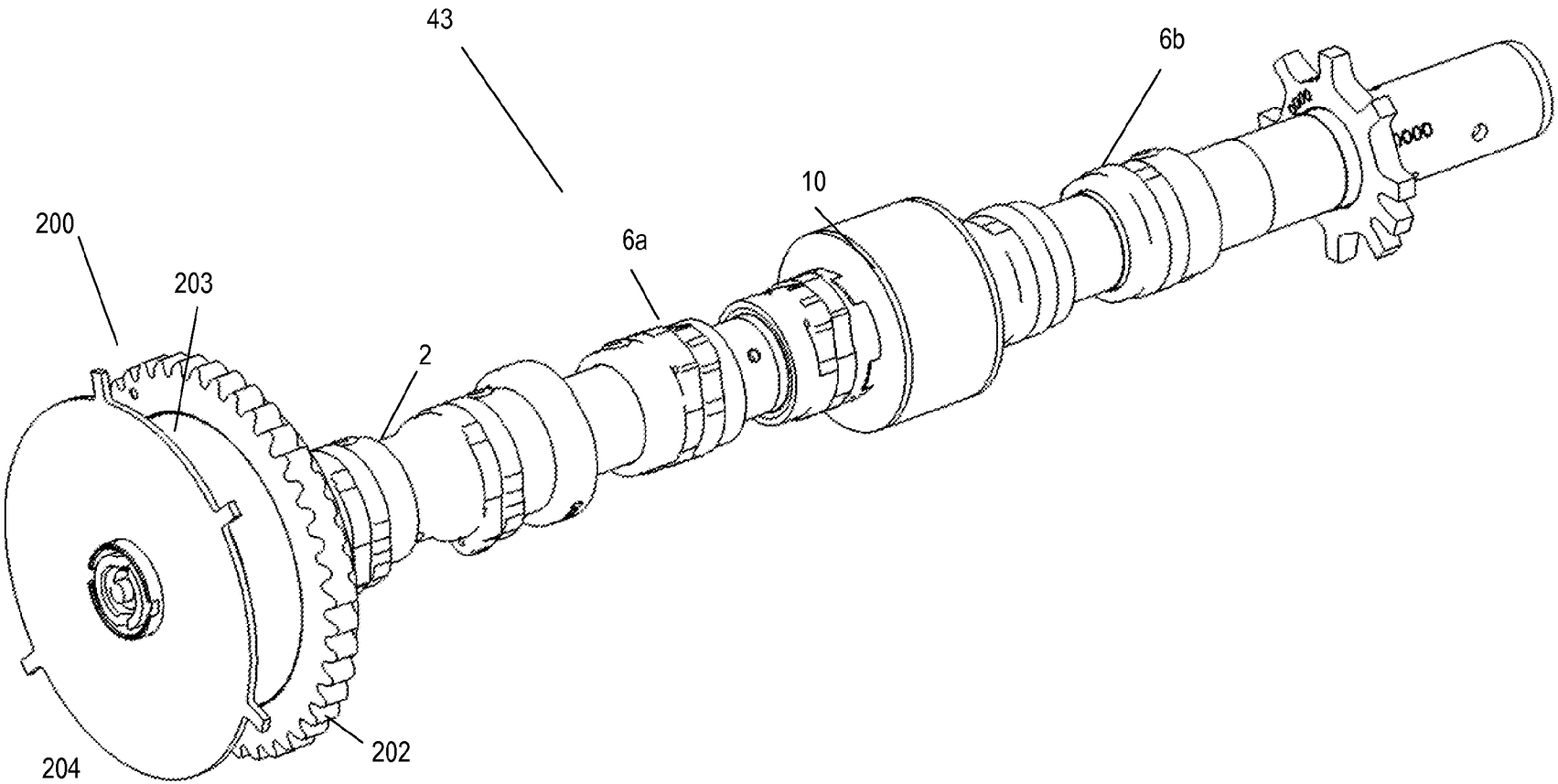
FIG. 25 shows another isometric view of a concentric camshaft with a centrally located valve event duration (VED) phaser and a variable cam timing (VCT) phaser at an end of a fourth embodiment.

FIGS. 23-25 show a camshaft assembly with a valve event duration (VED) phaser 10 approximately in the middle of the camshaft assembly 43 and a variable cam timing (VCT) phaser 200 on an end of the camshaft assembly 43.

The valve event duration (VED) phaser 10 maybe the VED phaser shown in FIGS. 1-7 and is preferably located approximately in the middle of the camshaft assembly 40 between two lobes 6*a*, 6*b*. Alternatively, the VED phaser, maybe the VED phaser shown in FIGS. 8-15. The VED phaser 10 includes a housing 12 connected to the inner shaft 4 through the movable portions 7 of the lobes 6*a*, 6*b*. The housing surrounds a rotor 14 which is pressed or welded onto the outer shaft 2. The rotor 14 has a series of vanes 16 which are received within chambers 17 formed between the first wall 23, the second wall 24, the inner diameter 25 of the housing 12 and the rotor 14. A vent 32 is present in the chamber 17. On one side of each vane is an oil feed channel 28. On either side of the housing 12 and rotor 14 are end plates 18, 20 one or both of which includes drive keys 19. The end plates 18, 20 are preferably welded to the housing 12. The drive keys 19 on one or both of the end plates 18, 20 interact and couple with drive keys 34 of movable split lobes 7 of the cam lobes 6*a*, 6*b* that are pinned 21 to the inner shaft 4.

A passage or groove 30 is cut on the inner shaft 4 and leads to an oil feed channel 28 on the vanes 16. A chamber 29 is formed between the inner diameter of the outer shaft 2 and the passage or groove 30 on the inner shaft 4. Through a bearing (not shown) on the outer shaft 2, a valve (not shown) provides fluid to the chamber 29 and to the oil fed channel 28 of the vanes 16 of the rotor 14. When the chamber 29 is pressurized, fluid moves into the oil feed channel 28 of the vane 16 and the chamber 17 formed between the housing 12 and the rotor 14, moving the vane 16 towards the second wall 24 of the chamber 17, moving the split lobes 6 connected to outer shaft 2 relative to the split lobes 7 connected to the inner shaft 4, extending the duration of the valve event.

The VED phaser 10 has at least three states, a holding state, a valve event duration extended state, and an initial state, allowing a range of position of the phaser and the lobes. In the initial state, the split lobes 6, 7 are aligned such that the cam noses 26, 27 of the split lobes are aligned with each other and the vanes 16 are adjacent the first wall 23 of the chamber 17 formed between the rotor 14 and the housing 12 and fluid is vented from the chamber 29 formed between the outer shaft 2 and the inner shaft 4 and the oil feed channel 28 on the vane 16 through the valve (not shown).

In a valve event duration extended state, fluid is supplied to the chamber 29 formed between the outer shaft 2 and the inner shaft 4 and the oil feed channel 28 on the vane 16, pressurizing the chamber 29 and moving the vane 16 towards the second wall 24. In the valve event duration extended state, the vane 16 may be moved until the vane 16 encounters the second wall 24 or to position in between the first wall 23 and the second wall 24. The valve event duration is extended by an amount based on the rotation of the vane 16 and the position of the vane 16 relative to the second wall 24.

A holding state may be present when the chamber 29 is pressurized and the valve (not shown) is moved to a position in which fluid is neither being supplied nor vented to the chamber 29. In this state, the valve event duration is maintained.

Unless the VED phaser 10 is being held, or moved to a valve event duration extended state, the valve (not shown) is moved to a venting state and torque on the concentric camshafts generated by the shape of the lobes 6, 7 moves the inner shaft 4 coupled to the housing 12. The torque is only present in one direction on the movable inner shaft 4. As the torque rotates the inner shaft 4, the drive keys 19 on one or both of the end plates 18, 20 connected to the housing 12 rotate, moving the housing 12 relative to the rotor 14 back to the initial state in which the vanes 16 are adjacent the first wall 23 of the chamber 17 formed between the housing 12 and the rotor 14 and the moveable cam noses 26 of the split lobes coupled to the housing 12 are rotated into alignment with the stationary cam noses 27 of the split lobes 6, 7 coupled to the rotor 14.

The VED phaser 10 may be oil pressure actuated where engine oil pressure is applied to one side of the vane, with or without a check valve in the supply line to each chamber. The check valve blocks oil pressure pulses due to torque fluctuating from propagating back into the oil system, and stops the vane from moving backward due to torque fluctuating.

In this concentric camshaft, the torque present is only in one direction and is present only on the inner shaft 4.

Centrally locating the VED phaser 10 in the between two lobes along the concentric camshafts shortens the effective length of the inner shaft and reduces the resonance and torsional deflection on the inner shaft.

VED phaser does not require any bolts in construction. The phaser is held together by welds or brazing. Additionally a lock pin is not necessary since only unidirectional torque is present on the moveable shaft.

A VCT phaser 200 is attached an end of the camshaft assembly 43 in which either the outer shaft 2 or the inner shaft 4 is extended. As shown in FIGS. 23-25, the outer shaft 2 is extended for mounting the rotor 214 (not shown) of the VCT phaser on. It should be noted that with the VCT phaser 200 mounted to the outer shaft, the inner shaft 4 does not extend into the VCT phaser 200.

The VCT phaser 200 has a rotor 214 (not shown) with one or more vanes (not shown), mounted to the end of the concentric camshaft assembly 43, surrounded by a housing 203 with the vane chambers (not shown) into which the vanes fit (not shown). It is possible to have the vanes mounted to the housing, and the chambers in the rotor, as well. A portion of the housing's outer circumference 202 forms the sprocket, pulley or gear accepting drive force through a chain, belt, or gears, usually from the crankshaft, or possible from another camshaft in a multiple-cam engine. The VCT phaser 200 is controlled by a control valve (not shown) mounted within the rotor.

The VED phaser 10 and the VCT phaser 200 run independent of each other. If the VED phaser 10 is mounted as shown in FIGS. 1-15, then the VCT phaser 200 changes the outer shaft 2 position only and changes the timing of the camshaft versus the crankshaft. Additionally, the VED phaser 10 controls the valve duration.

The VCT phaser 200 attached to the camshaft assembly 43 may be an oil pressure actuated (OPA), torsion assist (TA) as disclosed in U.S. Pat. No. 6,883,481, issued Apr. 26, 2005, entitled "TORSIONAL ASSISTED MULTI-POSITION CAM INDEXER HAVING CONTROLS LOCATED IN ROTOR" with a single check valve TA, and is herein incorporated by reference and/or U.S. Pat. No. 6,763,791, issued Jul. 20, 2004, entitled "CAM PHASER FOR ENGINES HAVING TWO CHECK VALVES IN ROTOR BETWEEN CHAMBERS AND SPOOL VALVE" which discloses two check valve TA, and is herein incorporated by reference, cam torque actuated (CTA) as disclosed in U.S. Pat. No. 5,107,804 issued Apr. 28, 1992, entitled "VARIABLE CAMSHAFT TIMING FOR INTERNAL COMBUSTION ENGINE" and is herein incorporated by reference, or hybrid as disclosed in U.S. Pat. No. 7,255,077, issued Aug. 14, 2007, entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, and a hybrid phaser as disclosed in U.S. patent publication No. 2006-0086332 A1 entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, although only a cam torque actuated phaser is shown in the drawings.

Figure 26:
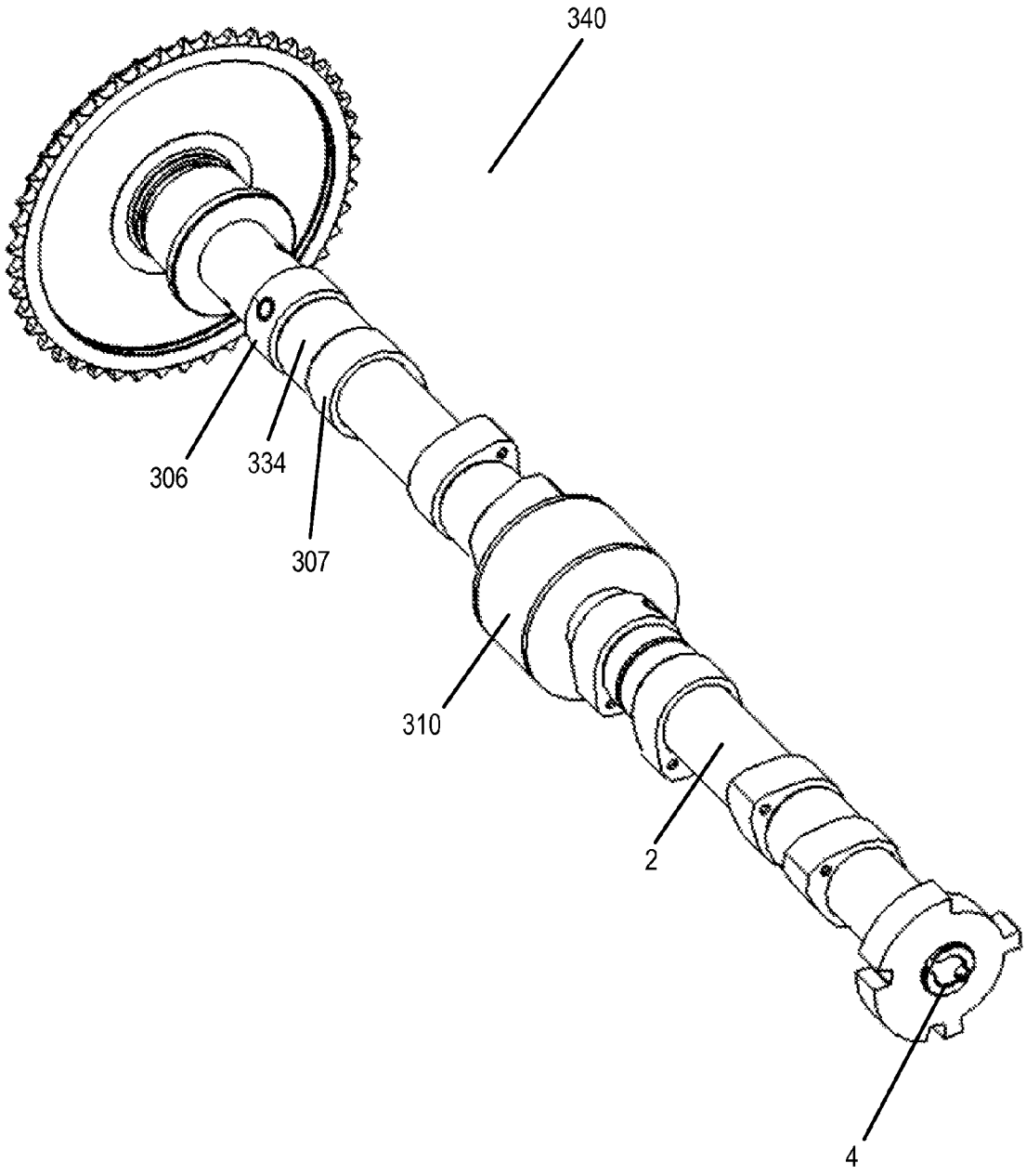
FIG. 26 shows an isometric view of a concentric camshaft with a centrally located valve event duration (VED) phaser of a fifth embodiment.
Figure 27:
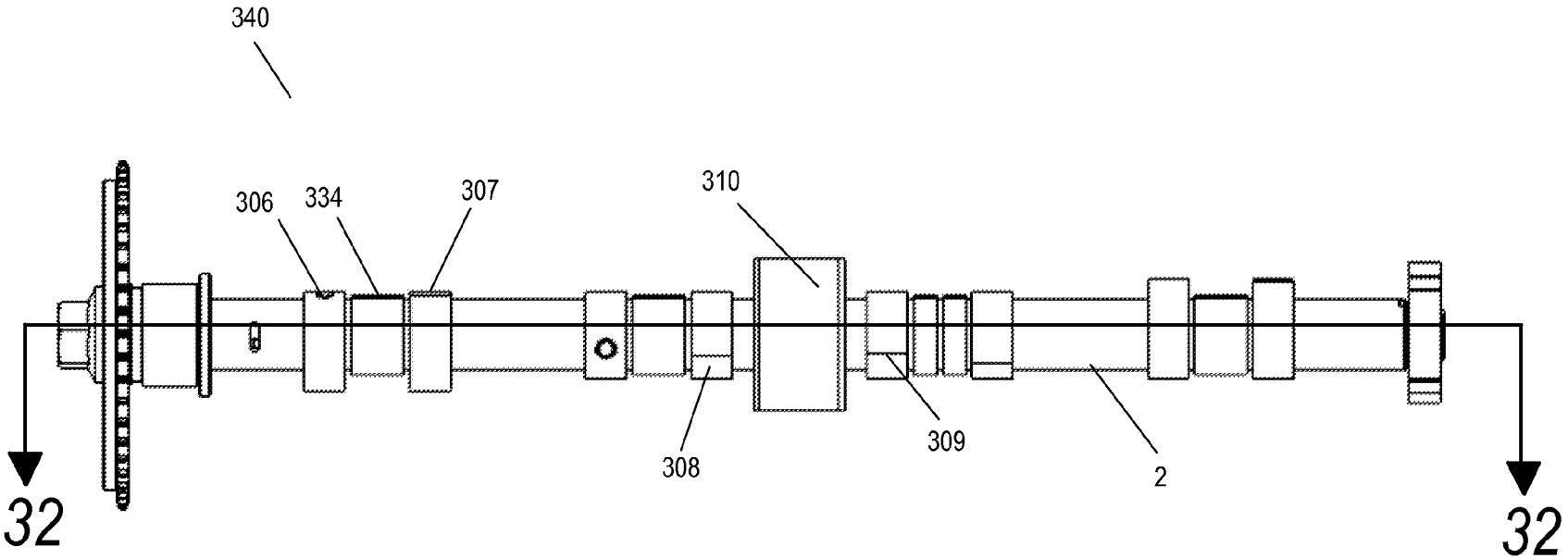
FIG. 27 shows a side view of a concentric camshaft with a centrally located valve event duration (VED) phaser of a fifth embodiment.
Figure 28:
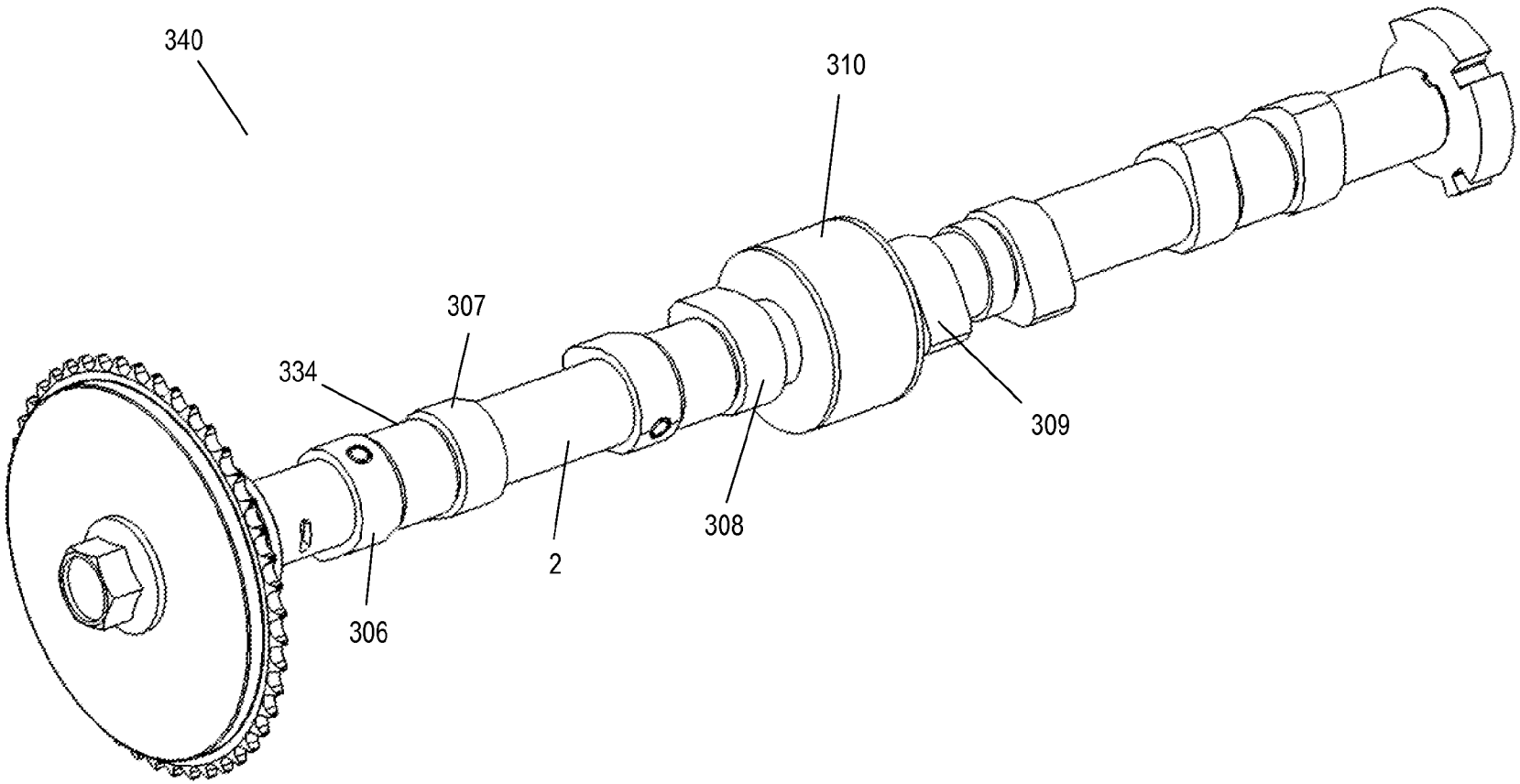
FIG. 28 shows another isometric view of concentric camshaft with a centrally located valve event duration (VED) phaser of a fifth embodiment.

FIGS. 26-28 show a concentric camshaft with a valve event duration (VED) phaser 10 preferably centrally located along concentric camshaft of a first embodiment. The camshaft assembly 340 has an inner shaft 4 and a hollow outer shaft 2. The outer shaft has slots 5 along its length. The outer shaft 2 surrounds the inner shaft 4 and the inner shaft 4 rotates within the outer shaft 2. The inner shaft 4 has multiple holes 5 that run perpendicular to the length of the shaft. The inner shaft 4 is placed within the outer shaft 2.

The concentric camshaft has a first set of cam lobes 307 rigidly attached to the outer shaft 2 and a second set of cam lobes 306 free to rotate and placed on the outer shaft 2 with a clearance fit. In between the first set of cam lobes 307 and the second set of cam lobes 306 are preferably bearings 334. The second set of cam lobes 306 are positioned over slots (not shown) on the outer shaft 2 and are controlled by the inner shaft 4 through a mechanical connection such as a pin and moves relative to the stationary first set of cam lobes 307. Each cam lobe has its own cam follower (not shown).

A valve event duration (VED) phaser 310 is preferably located approximately in the middle of the camshaft assembly 340 between two lobes 308, 309. The VED phaser 310, as includes a housing 312 connected to the inner shaft 4 through the movable portions second set of cam lobes 307 that are free to rotate and connected to the inner shaft 4 by mechanical connections. The housing surrounds a rotor 314 which is pressed or welded onto the outer shaft 2. The rotor 314 has a series of vanes (not shown) which are received within chambers (not shown) formed between the rotor 314 and the housing 312. The vanes (not shown) divide the chambers into a first pressure chamber 328 and a second pressure chamber 333.

A first passage or groove 330 is cut on the inner shaft 4 and leads to the first pressure chamber 328. A second passage or groove 332 is cut on another portion of the inner shaft and leads to the second pressure chamber 333. Through a bearing 334 on the outer shaft 2, a valve (not shown) provides fluid to the first pressure chamber 328 or the second pressure chamber 333.

When the first passage or groove 330 is pressurized and fluid fills the first pressure chamber 328, the vane (not shown) moves in a first direction causing the fluid in the second pressure chamber 333 to exit to sump through a valve (not shown). The movement of the vane (not shown) in this first direction moves the second set of cam lobes 307 connected to the inner shaft 4 relative to the first set of cam lobes 306 on the outer shaft 2, changing the relative timing of the first set of cam lobes 306 relative to the second set of cam lobes 307.

When the second passage or groove 332 is pressurized and fluid fills the second pressure chamber 333, the vane (not shown) moves in a second direction causing the fluid in the first pressure chamber 328 to exit to sump through a valve (not shown). The movement of the vane (not shown) in this second direction, moves the second set of cam lobes 307 connected to the inner shaft relative to the first set of cam lobes 306 on the outer shaft 2, back to an initial state.

The VED phaser 310 has at least three states, a holding state, altered valve timing state, and an initial state, allowing a range of positions of the VED phaser and the lobes. In the initial state, the vane (not shown) is in a position immediately adjacent a wall in the chamber formed between the housing 312 and the rotor 314 and fluid in the first pressure chamber 328 has exhausted to sump and the second pressure chamber 333 is filled with fluid.

In the altered valve timing state, the vane is in a position immediately adjacent a wall in the chamber formed between the housing 312 and the rotor 314, opposite of the wall in which the vane is adjacent in the initial state. Fluid in the second pressure chamber 333 has exhausted to sump and the first pressure chamber 328 is filled with fluid.

A holding state may be present when both the first pressure chamber 328 and the second pressure chamber 333 are pressurized and the valve (not shown) is moved to a position in which fluid is neither being supplied nor vented to the first and second pressure chambers 328, 333. In this state, the altered valve timing is maintained.

Since the torque is generated in both directions, the VED phaser 310 has to be moved to the at least three states; a holding state, altered valve timing state, and an initial state.

Centrally locating the VED phaser 310 in the between two lobes along the concentric camshafts shortens the effective length of the inner shaft and reduces the torsional deflection on the inner shaft.

VED phaser does not require any bolts in construction. The phaser is held together by welds or brazing.

Figure 29:
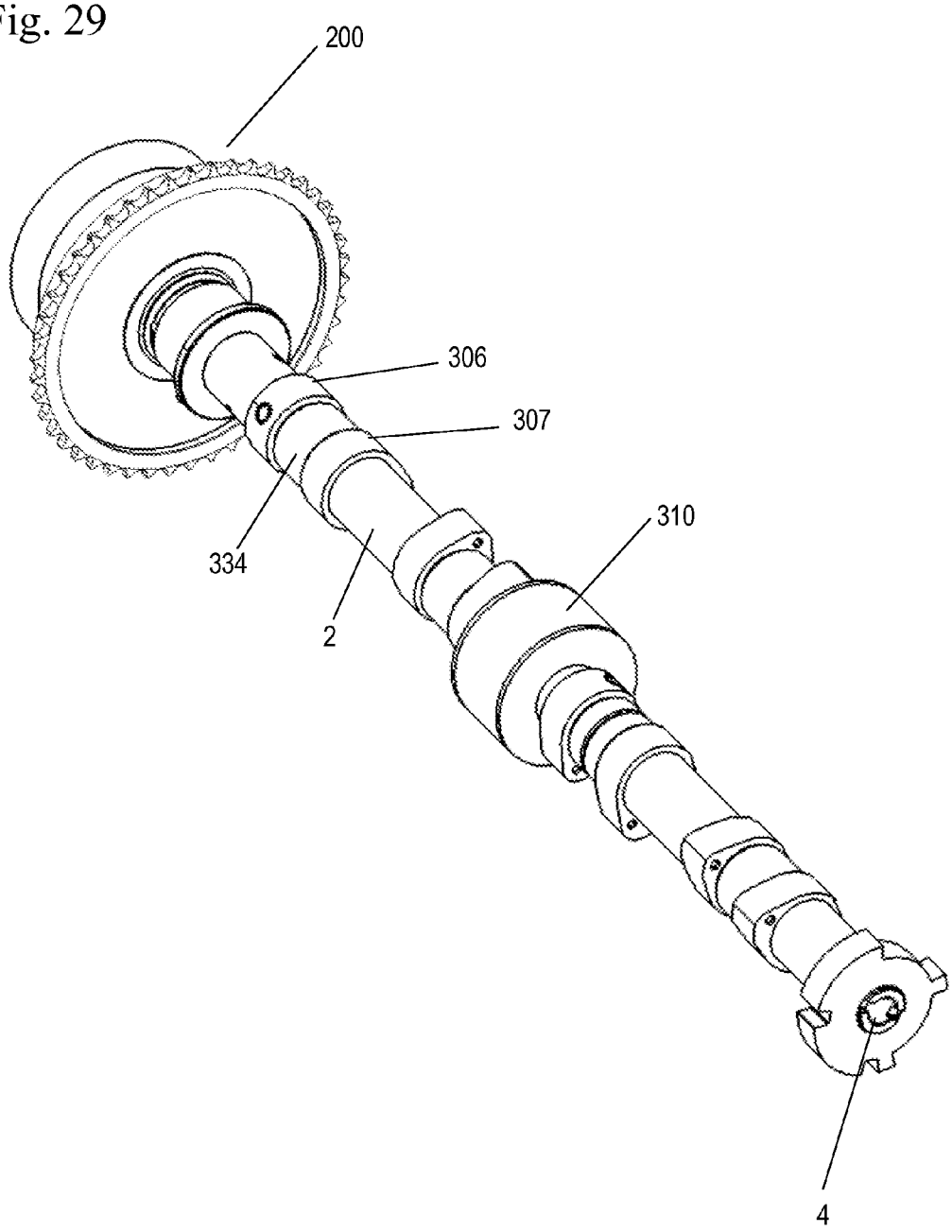
FIG. 29 shows an isometric view concentric camshaft with a centrally located valve event duration (VED) phaser and a variable cam timing (VCT) phaser at an end of a sixth embodiment.
Figure 30:
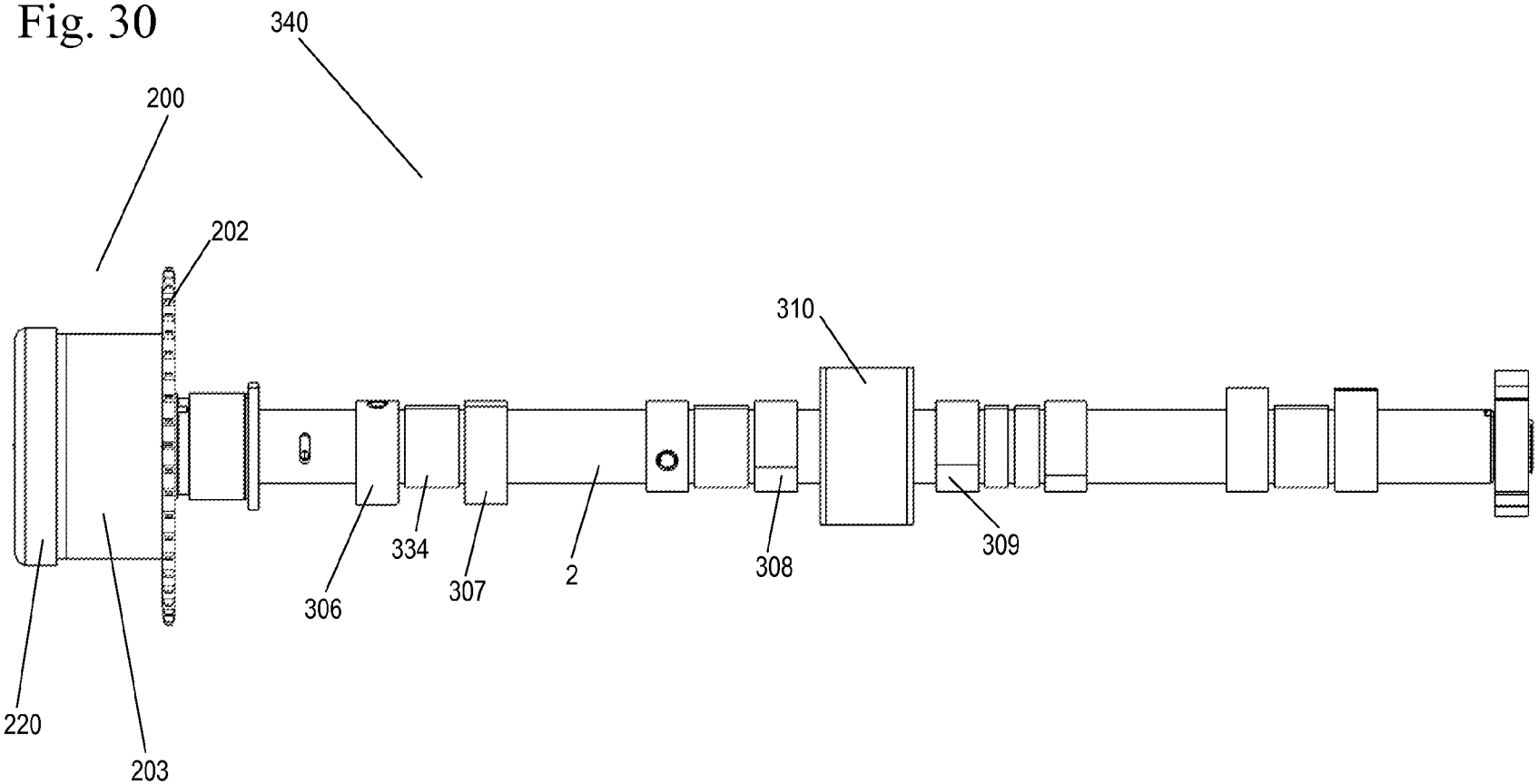
FIG. 30 shows a side view concentric camshaft with a centrally located valve event duration (VED) phaser and a variable cam timing (VCT) phaser at an end of a sixth embodiment.
Figure 31:
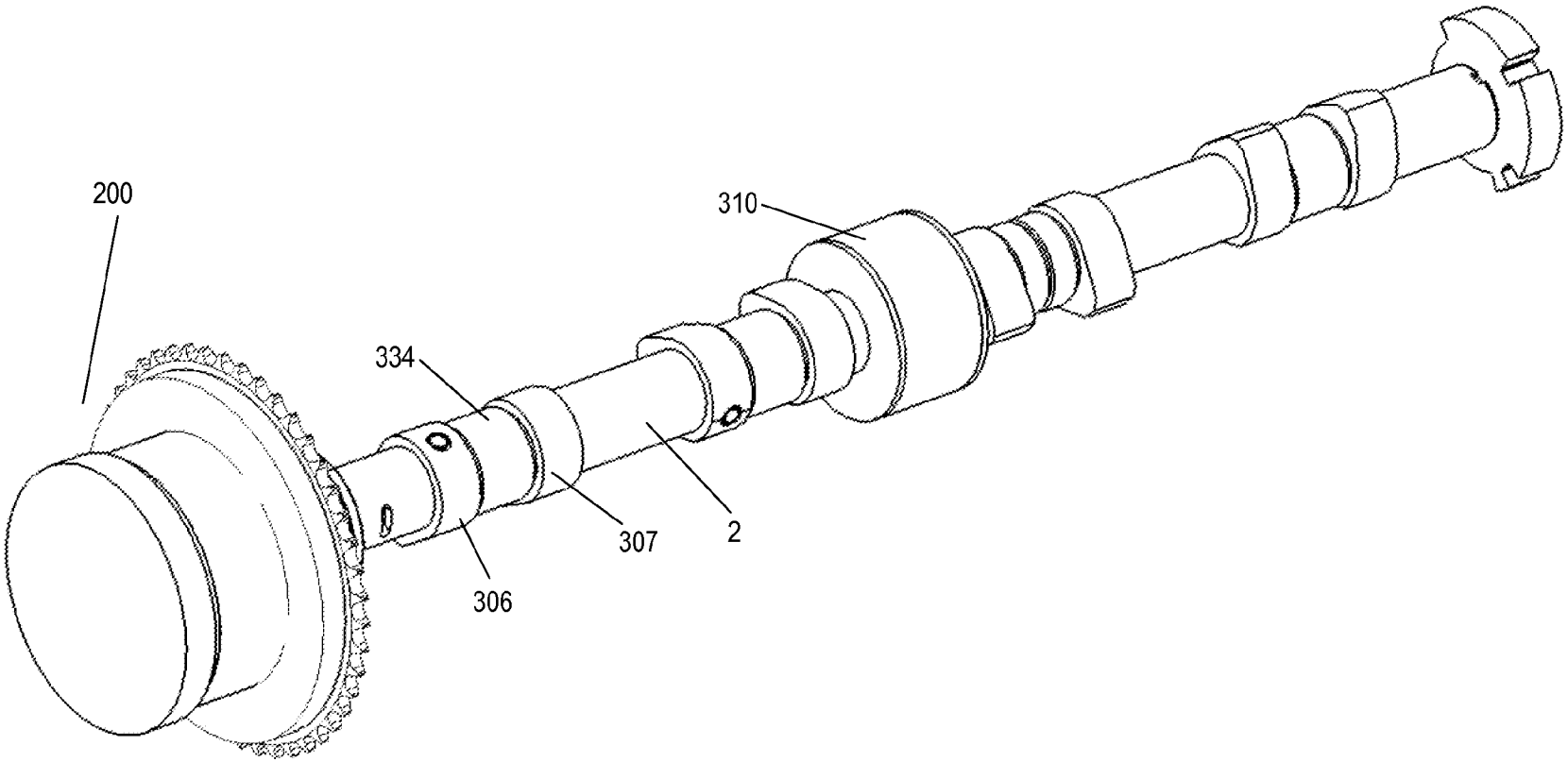
FIG. 31 shows another isometric view concentric camshaft with a centrally located valve event duration (VED) phaser and a variable cam timing (VCT) phaser at an end of a sixth embodiment.

FIGS. 29-31 show a camshaft assembly with a valve event duration (VED) phaser 310 approximately in the middle of the camshaft assembly and a variable cam timing (VCT) phaser 200 on an end of the camshaft assembly 342.

Figure 32:
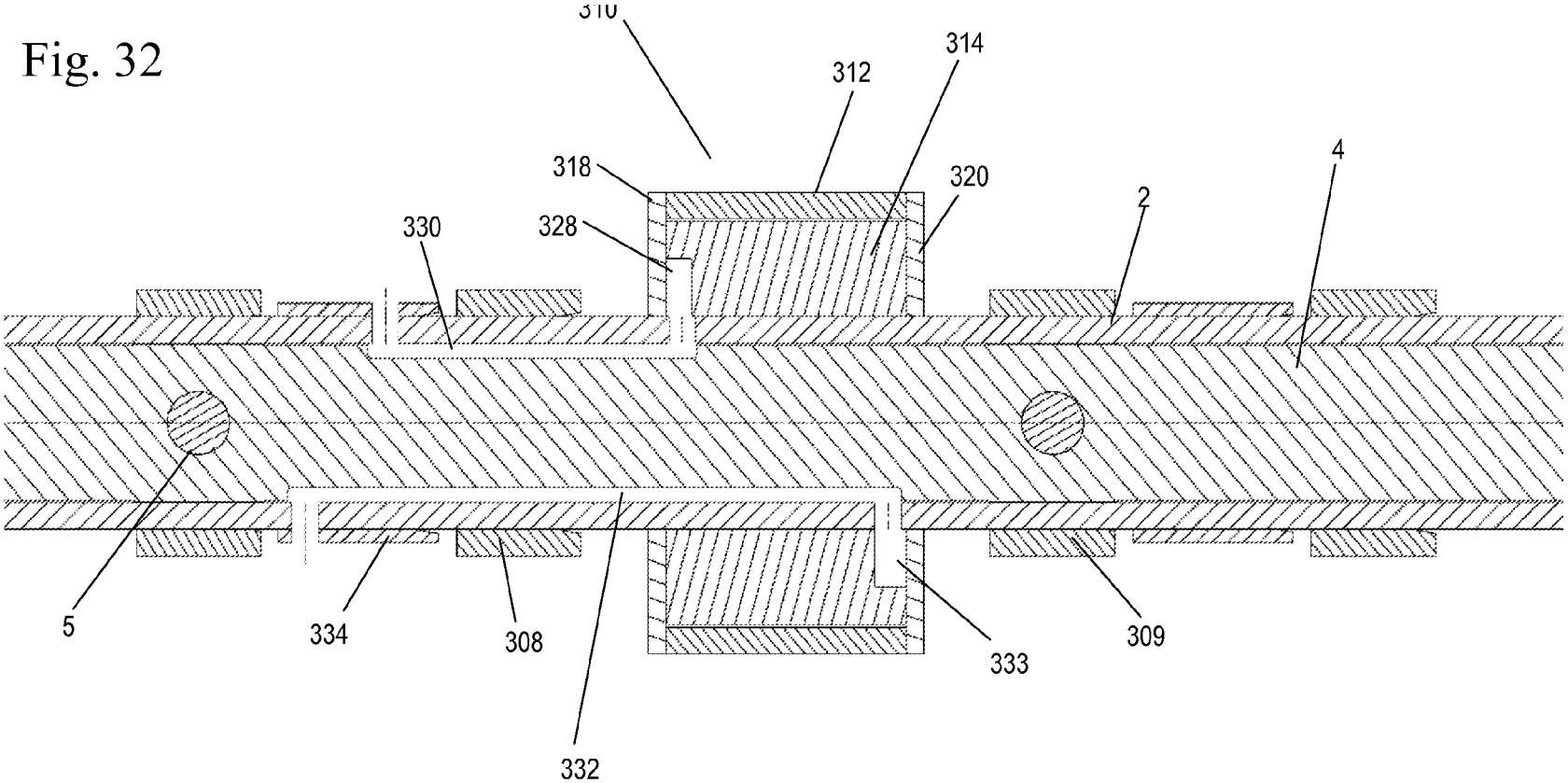
FIG. 32 shows a cross-section of the concentric camshaft and valve event duration (VED) phaser of the fifth and sixth embodiment along line 32-32 of FIG. 27.

The valve event duration (VED) phaser 310 is preferably the VED phaser shown in FIG. 32 and is located approximately in the middle of the camshaft assembly 342 between two lobes 308 and 309.

A valve event duration (VED) phaser 310 is preferably located approximately in the middle of the camshaft assembly 340 between two lobes 308, 309. The VED phaser 310, as includes a housing 312 connected to the inner shaft 4 through the movable portions second set of cam lobes 307 that are free to rotate and connected to the inner shaft 4 by mechanical connections. The housing surrounds a rotor 314 which is pressed or welded onto the outer shaft 2. The rotor 314 has a series of vanes (not shown) which are received within chambers (not shown) formed between the rotor 314 and the housing 312. The vanes (not shown) divide the chambers into a first pressure chamber 328 and a second pressure chamber 333.

A first passage or groove 330 is cut on the inner shaft 4 and leads to the first pressure chamber 328. A second passage or groove 332 is cut on another portion of the inner shaft and leads to the second pressure chamber 333. Through a bearing 334 on the outer shaft 2, a valve (not shown) provides fluid to the first pressure chamber 328 or the second pressure chamber 333.

When the first passage or groove 330 is pressurized and fluid fills the first pressure chamber 328, the vane (not shown) moves in a first direction causing the fluid in the second pressure chamber 333 to exit to sump through a valve (not shown). The movement of the vane (not shown) in this first direction moves the second set of cam lobes 307 connected to the inner shaft 4 relative to the first set of cam lobes 306 on the outer shaft 2, changing the relative timing of the first set of cam lobes 306 relative to the second set of cam lobes 307.

When the second passage or groove 332 is pressurized and fluid fills the second pressure chamber 333, the vane (not shown) moves in a second direction causing the fluid in the first pressure chamber 328 to exit to sump through a valve (not shown). The movement of the vane (not shown) in this second direction, moves the second set of cam lobes 307 connected to the inner shaft relative to the first set of cam lobes 306 on the outer shaft 2, back to an initial state.

The VED phaser 310 has at least three states, a holding state, altered valve timing state, and an initial state, allowing a range of positions of the VED phaser and the lobes. In the initial state, the vane (not shown) is in a position immediately adjacent a wall in the chamber formed between the housing 312 and the rotor 314 and fluid in the first pressure chamber 328 has exhausted to sump and the second pressure chamber 333 is filled with fluid.

In the altered valve timing state, the vane is in a position immediately adjacent a wall in the chamber formed between the housing 312 and the rotor 314, opposite of the wall in which the vane is adjacent in the initial state. Fluid in the second pressure chamber 333 has exhausted to sump and the first pressure chamber 328 is filled with fluid.

A holding state may be present when both the first pressure chamber 328 and the second pressure chamber 333 are pressurized and the valve (not shown) is moved to a position in which fluid is neither being supplied nor vented to the first and second pressure chambers 328, 333. In this state, the altered valve timing is maintained.

Since the torque is generated in both directions, the VED phaser 310 has to be moved to the at least three states; a holding state, altered valve timing state, and an initial state.

A VCT phaser 200 is attached an end of the camshaft assembly 43 in which either the outer shaft 2 or the inner shaft 4 is extended. It should be noted that with the VCT phaser 200 mounted to the outer shaft, the inner shaft 4 does not extend into the VCT phaser 200.

The VCT phaser 200 has a rotor 214 (not shown) with one or more vanes (not shown), mounted to the end of the concentric camshaft assembly 43, surrounded by a housing 203 with the vane chambers (not shown) into which the vanes fit (not shown). It is possible to have the vanes mounted to the housing, and the chambers in the rotor, as well. A portion of the housing's outer circumference 202 forms the sprocket, pulley or gear accepting drive force through a chain, belt, or gears, usually from the crankshaft, or possible from another camshaft in a multiple-cam engine. The VCT phaser 200 is controlled by a control valve (not shown) mounted within the rotor.

The VED phaser 310 and the VCT phaser 200 run independent of each other. If the VED phaser 310 is mounted in the middle of the phaser and to the inner shaft, then the VCT phaser 200 changes the outer shaft 2 position only and changes the timing of the camshaft versus the crankshaft. Additionally, the VED phaser 310 controls the valve duration.

The VCT phaser 200 attached to the camshaft assembly 342 may be an oil pressure actuated (OPA), torsion assist (TA) as disclosed in U.S. Pat. No. 6,883,481, issued Apr. 26, 2005, entitled "TORSIONAL ASSISTED MULTI-POSITION CAM INDEXER HAVING CONTROLS LOCATED IN ROTOR" with a single check valve TA, and is herein incorporated by reference and/or U.S. Pat. No. 6,763,791, issued Jul. 20, 2004, entitled "CAM PHASER FOR ENGINES HAVING TWO CHECK VALVES IN ROTOR BETWEEN CHAMBERS AND SPOOL VALVE" which discloses two check valve TA, and is herein incorporated by reference, cam torque actuated (CTA) as disclosed in U.S. Pat. No. 5,107,804 issued Apr. 28, 1992, entitled "VARIABLE CAMSHAFT TIMING FOR INTERNAL COMBUSTION ENGINE" and is herein incorporated by reference, or hybrid as disclosed in U.S. Pat. No. 7,255,077, issued Aug. 14, 2007, entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, and a hybrid phaser as disclosed in US patent publication No. 2006-0086332 A1 entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, although only a cam torque actuated phaser is shown in the drawings.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A camshaft assembly for extending duration of a valve event comprising:

a hollow outer shaft;

an inner shaft received within the hollow outer shaft;

a plurality of cam lobes each split into at least a first set of stationary lobes fixed to the inner shaft or the outer shaft and at least a second set of lobes which rotate relative to the first set of lobes and are mounted to the other inner shaft or outer shaft through a mechanical connection;

a phaser located between the plurality of cam lobes.

2. The camshaft assembly of claim 1, further comprising a chamber defined between the inner shaft and the outer shaft in fluid communication with an oil source.

3. The camshaft assembly of claim 1, wherein the phaser is a variable event duration phaser comprising:

a housing comprising an inner diameter and coupled to the inner shaft through second set of lobes;

a rotor coaxially located within the housing and fixedly attached to the outer shaft of the camshaft assembly, the housing and the rotor defining at least one vane separating a chamber in the housing, the chamber in the housing defined by the inner diameter of the housing, the rotor, a first wall and a second wall, the vane being capable of rotation to shift the relative angular position of the housing and the rotor and comprising an oil feed channel in fluid communication with the chamber between the inner shaft and the outer shaft;

a first end plate fixedly attached to the housing on a first side of the housing and the rotor and adjacent to the stationary lobe fixed to the outer shaft; and a second endplate fixedly attached to the housing on a second side of the housing, opposite the first side, adjacent to the stationary lobe fixed to the outer shaft;

wherein when the chamber between the inner shaft and the outer shaft is pressurized by fluid, fluid moves into the oil feed channel of the vane and moves the vane towards the second wall and the split lobes connected to the outer shaft relative to the split lobes connected to the inner shaft, extending the duration of the valve event.

4. The camshaft assembly of claim 3, wherein the duration of the valve event is extended by an amount based on rotation of the vane and position of the vane relative to the second wall of the housing.

5. The camshaft assembly of claim 3, wherein the chamber formed between the housing and the rotor in the variable event phaser further comprises a vent leading to atmosphere.

6. The camshaft assembly of claim 3, wherein one of the stationary lobes and the first end plate are one piece.

7. The camshaft assembly of claim 3, wherein one of the stationary lobes and the second end plate are one piece.

8. The camshaft assembly of claim 3, wherein the first end plate, the second end plate, and the stationary lobes adjacent the first end plate and the second end plate further comprise keys, wherein the keys on the first end plate and the second end plate mesh with the keys on the stationary lobes.

9. The camshaft assembly of claim 1, wherein the first set of stationary lobes and the second set of lobes share one cam follower.

10. The camshaft assembly of claim 1, further comprising a variable cam timing phaser mounted to the outer shaft at one end, the variable cam timing phaser comprising:

a housing with an outer circumference for accepting drive force mounted to the outer shaft;

a rotor coaxially located within the housing, the housing and the rotor defining at least one vane separating a chamber in the housing, the vane being capable of rotation to shift the relative angular position of the housing and the rotor; and a control valve received by rotor for directing fluid to the chambers.

11. The camshaft assembly of claim 10, wherein the variable cam timing phaser is oil pressure actuated, cam torque actuated, hybrid, or torsion assist.

12. The camshaft assembly of claim 1, wherein the outer shaft is comprised of multiple pieces.

13. A camshaft assembly for extending duration of a valve event comprising:

a hollow outer shaft;

an inner shaft received within the hollow outer shaft;

a plurality of cam lobes comprising a first set of stationary cam lobes fixed to the inner shaft or the outer shaft and at least a second set of cam lobes which rotate relative to the first set of cam lobes and are mounted to the other inner shaft or outer shaft through a mechanical connection;

a phaser located between the plurality of cam lobes.

14. The camshaft assembly of claim 13, further comprising a first passage defined between the inner shaft and the outer shaft in fluid communication with an oil source and a second passage defined between the inner shaft and the outer shaft in fluid communication with the oil source.

15. The camshaft assembly of claim 13, wherein the phaser is a variable event duration phaser comprising:

a housing coupled to the inner shaft through second set of lobes;

a rotor coaxially located within the housing and fixedly attached to the outer shaft of the camshaft assembly, the housing and the rotor defining at least one vane separating a chamber in the housing into a first pressure chamber and a second pressure chamber, the vane being capable of rotation to shift the relative angular position of the housing and the rotor and comprising a first passage between the inner shaft and the outer shaft in fluid communication with the first pressure chamber and a second passage between the inner shaft and the outer shaft in fluid communication with the second pressure chamber;

wherein when the first pressure chamber is pressurized by fluid, the vane moves, fluid in the second pressure chamber exits to sump, and the first set of cam lobes connected to the inner shaft move relative to the second set of cam lobes connected to the outer shaft, altering the relative timing of the first set of cam lobes relative to the second set of cam lobes.

16. The camshaft assembly of claim 13, wherein the stationary cam lobes and the second cam lobes each have one cam follower.

17. The camshaft assembly of claim 13, further comprising a variable cam timing phaser mounted to the outer shaft at one end, the variable cam timing phaser comprising:

a housing with an outer circumference for accepting drive force mounted to the outer shaft;

a rotor coaxially located within the housing, the housing and the rotor defining at least one vane separating a chamber in the housing, the vane being capable of rotation to shift the relative angular position of the housing and the rotor; and a control valve received by rotor for directing fluid to the chambers.

18. The camshaft assembly of claim 17, wherein the variable cam timing phaser is oil pressure actuated, cam torque actuated, hybrid, or torsion assist.

* * * * *